US010836414B2

(12) United States Patent
Israelsson et al.

(10) Patent No.: US 10,836,414 B2
(45) Date of Patent: Nov. 17, 2020

(54) METHOD AND SYSTEM FOR SHARING OF INFORMATION PERTINENT AT A RAILWAY CROSSING

(71) Applicant: VOLVO CAR CORPORATION, Gothenburg (SE)

(72) Inventors: Erik Israelsson, Gothenburg (SE); Johannes Ohlin, Gothenburg (SE); Sebastian Thelen, Askim (SE)

(73) Assignee: VOLVO CAR CORPORATION, Gothenburg (SE)

( * ) Notice: Subject to any disclaimer, the term of this patent is extended or adjusted under 35 U.S.C. 154(b) by 357 days.

(21) Appl. No.: 15/874,432

(22) Filed: Jan. 18, 2018

(65) Prior Publication Data

US 2018/0208223 A1 Jul. 26, 2018

(30) Foreign Application Priority Data

Jan. 25, 2017 (EP) ..... 17153036

(51) Int. Cl.
*B61L 29/32* (2006.01)
*B61L 23/34* (2006.01)
(Continued)

(52) U.S. Cl.
CPC ..... *B61L 29/32* (2013.01); *B61L 23/34* (2013.01); *B61L 29/22* (2013.01); *B61L 29/246* (2013.01);
(Continued)

(58) Field of Classification Search
CPC ..... B61L 29/22; B61L 29/24; B61L 29/246; B61L 29/30; B61L 29/32; B61L 23/041;
(Continued)

(56) References Cited

U.S. PATENT DOCUMENTS 5,729,213 A 3/1998 Ferrari et al.
8,340,894 B2 * 12/2012 Yester ..... G08G 1/163 340/436
(Continued)

FOREIGN PATENT DOCUMENTS

AT 503852 A4 1/2008
CN 2743196 Y 11/2005
(Continued)

OTHER PUBLICATIONS

Extended European Search Report and Written Opinion dated Nov. 2, 2017, from related European Application No. 171530363, 5 pages.
(Continued)

*Primary Examiner* — Zachary L Kuhfuss
(74) *Attorney, Agent, or Firm* — Brooks Kushman P.C.

(57) ABSTRACT

An information sharing system derives from a roadway vehicles management system position-related data of a roadway vehicle along a road and determines a roadway vehicle timing at or during which the roadway vehicle is estimated to arrive at or cross a railway crossing. The information sharing system further derives from a railway vehicles management system position-related data of a railway vehicle along the railway and determines a railway vehicle timing at or during which the railway vehicle is estimated to arrive at or have passed the railway crossing. The information sharing system determines, based on comparing a roadway vehicle time window to a railway vehicle time window, that the roadway vehicle time window and the railway vehicle time window at least partly overlap. The information sharing system provides information associated with the overlap to the roadway vehicle or the railway vehicle.

20 Claims, 9 Drawing Sheets

(51) Int. Cl.
*B61L 29/22* (2006.01)
*B61L 29/24* (2006.01)
*G08G 1/0967* (2006.01)
*B61L 29/30* (2006.01)

(52) U.S. Cl.
CPC ..... *B61L 29/30* (2013.01); *G08G 1/096716* (2013.01); *G08G 1/096741* (2013.01); *G08G 1/096783* (2013.01)

(58) Field of Classification Search
CPC .. B61L 23/34; G08G 1/017; G08G 1/096716; G08G 1/096741; G08G 1/096783
See application file for complete search history.

(56) References Cited

U.S. PATENT DOCUMENTS 8,596,587 B2 * 12/2013 Hilleary ..... B61L 23/041 246/125
8,838,301 B2 * 9/2014 Makkinejad ..... B61L 25/025 701/19
8,868,141 B2 * 10/2014 Subramanian ..... G01C 21/20 455/574
8,903,639 B2 * 12/2014 Yester ..... G08G 1/163 340/436
9,019,115 B2 * 4/2015 Ballinger ..... B61L 29/24 246/292
9,026,360 B2 * 5/2015 Fries ..... B61L 29/04 246/126
9,126,609 B2 * 9/2015 Steffen, II ..... B61L 23/00
9,150,229 B2 * 10/2015 Steffen ..... B61L 29/32
9,321,460 B2 * 4/2016 Sasabuchi ..... G01S 17/931
9,688,297 B2 * 6/2017 Ryan ..... B61L 29/24
10,249,204 B2 * 4/2019 Townsend ..... G08G 7/02
10,507,854 B2 * 12/2019 DeJarnatt ..... B61L 29/24
2005/0231387 A1 * 10/2005 Markelz ..... B61L 23/041 340/937
2008/0169939 A1 * 7/2008 Dickens ..... B61L 29/226 340/910
2009/0115633 A1 * 5/2009 Lawry ..... B61L 29/32 340/936
2011/0084176 A1 * 4/2011 Reichelt ..... B61L 23/041 246/473.1
2011/0087433 A1 * 4/2011 Yester ..... G08G 1/163 701/301
2013/0194423 A1 * 8/2013 Baines ..... B61L 29/28 348/148
2013/0200223 A1 8/2013 Alexander et al.
2013/0261950 A1 * 10/2013 Sasabuchi ..... B61L 29/246 701/301
2013/0289805 A1 * 10/2013 Makkinejad ..... B61L 29/32 701/19
2013/0325344 A1 * 12/2013 Yester ..... G08G 1/163 701/533
2016/0189552 A1 * 6/2016 Hilleary ..... G08G 7/02 246/125
2018/0208223 A1 * 7/2018 Israelsson ..... B61L 29/22
2019/0077434 A1 * 3/2019 Toshack ..... B61L 29/32
2019/0135316 A1 * 5/2019 Hilleary ..... G01S 13/87
2019/0135317 A1 * 5/2019 Hilleary ..... G01S 13/87
2019/0212156 A1 * 7/2019 Ghannam ..... G08G 1/096741

FOREIGN PATENT DOCUMENTS

CN 103359034 A 10/2013
DE 102008010413 A1 8/2009
DE 102012102893 A1 10/2013
EP 2645126 A1 10/2013
WO 2005000659 A1 1/2005

OTHER PUBLICATIONS

Chinese Office Action, Appl. No. 201810047801.1 dated Jul. 13, 2020 and Machine Translation.
Chinese Search Report, Appl. No. 201810047801.1 dated Jul. 6, 2020.

* cited by examiner

METHOD AND SYSTEM FOR SHARING OF INFORMATION PERTINENT AT A RAILWAY CROSSING

CROSS-REFERENCE TO RELATED APPLICATIONS

This application claims foreign priority benefits under 35 U.S.C. § 119(a)-(d) to European patent application number EP 17153036.3, filed Jan. 25, 2017, which is incorporated by reference in its entirety.

TECHNICAL FIELD

The present disclosure relates to an information sharing system and a method performed therein for sharing of information pertinent a railway crossing of a road and a railway.

BACKGROUND

Inevitably, railways of railway networks and roads of roadway networks are now and again bound to intersect at railway crossings, at the same level. Every such railway crossing may affect traveling of a roadway vehicle and potentially traveling of a railway vehicle—and/or may imply a collision risk between said vehicles—should said vehicles arrive at, be positioned at, pass and/or cross said railway crossing during essentially the same period of time. Although numerous solutions have been developed and are available for informing and/or warning a vehicle and/or a driver thereof—and/or a roadway vehicle and/or driver thereof—of an upcoming railway crossing and further of a vehicle approaching said railway crossing, providing relevant information pertinent thereto remains challenging.

SUMMARY

It is therefore an object of embodiments herein to provide an approach for in an improved and/or alternative manner share information pertinent a railway crossing.

According to a first embodiment herein, the object is achieved by a method performed by an information sharing system for sharing of information pertinent a railway crossing of a road and a railway. The information sharing system is associated with a roadway vehicles management system holding vehicle status data of one or more roadway vehicles. The information sharing system derives, from the roadway vehicles management system, position-related data of a roadway vehicle along the road. The information sharing system further determines, based on the roadway vehicle position-related data, a roadway vehicle timing at and/or during which the roadway vehicle is estimated to arrive at and/or cross the railway crossing. Moreover, the information sharing system derives from a railway vehicles management system holding vehicle status data of one or more railway vehicles, position-related data of a railway vehicle along the railway. The information sharing system further determines, based on the railway vehicle position-related data, a railway vehicle timing at and/or during which the railway vehicle is estimated to arrive at and/or have passed the railway crossing. Moreover, the information sharing system determines, based on comparing a roadway vehicle time window comprising the roadway vehicle timing, to a railway vehicle time window comprising the railway vehicle timing, that the roadway vehicle time window at least partly overlaps the railway vehicle time window. Furthermore, the information sharing system provides information associated with the expected overlap, to the roadway vehicle and/or to the railway vehicle.

Thereby, by introducing a method performed by an information sharing system for sharing of information pertinent a railway crossing of a road and a railway, an approach is provided which enables information related to said railway crossing to be communicated. Moreover, since the information sharing system is associated with a roadway vehicles management system holding vehicle status data of one or more roadway vehicles, the information sharing system is in connection with a system adapted to wirelessly communicate directly or indirectly with roadway vehicles, derive and/or receive vehicle status data from the roadway vehicles, and hold information associated with the roadway vehicles such as said vehicle status data. Furthermore, since position-related data of a roadway vehicle along the road is derived from the roadway vehicles management system, there is established data of geographical whereabouts of at least one roadway vehicle with which the roadway vehicles management system communicates and/or recently has been communicating and from which roadway vehicle the roadway vehicles management system has retrieved information on which said position-related data is based. Moreover, since the information sharing system determines—based on the roadway vehicle position-related data—a roadway vehicle timing at and/or during which the roadway vehicle is estimated to arrive at and/or cross the railway crossing, there is established a point in time and/or time period when the roadway vehicle is likely to reach and/or drive through the railway crossing. Furthermore, since position-related data of a railway vehicle along the railway is derived from a railway vehicles management system holding vehicle status data of one or more railway vehicles, data of geographical whereabouts of at least one railway vehicle is retrieved from a system keeping track of one or more railway vehicles positioned along the railway. Moreover, since the information sharing system determines—based on the railway vehicle position-related data—a railway vehicle timing at and/or during which the railway vehicle is estimated to arrive at and/or have passed the railway crossing, there is established a point in time and/or time period when the railway vehicle is likely to reach and/or have proceeded through the railway crossing. Furthermore, since—based on comparing a roadway vehicle time window comprising the roadway vehicle timing to a railway vehicle time window comprising the railway vehicle timing—it is determined that the roadway vehicle time window at least partly overlaps the railway vehicle time window, it is established that a time range including the roadway vehicle timing at least to some extent occurs at the same point and/or period of time as a time range including the railway vehicle timing. Moreover, since the information sharing system provides information associated with the expected overlap to the roadway vehicle and/or to the railway vehicle, information related to and/or derived from the assumed time overlap is communicated to either or both of said vehicles. Thereby, a roadway vehicle may receive information related to a railway vehicle presumably about to arrive at and/or pass a roadway crossing at a timing considered near a timing when said roadway vehicle is estimated to arrive at and/or cross said roadway crossing, the railway vehicle's traveling thus potentially affecting the roadway vehicle's traveling. Similarly, thereby, a railway vehicle may receive information related to a roadway vehicle presumably about to arrive at and/or cross a roadway crossing at a timing considered near a timing when said railway vehicle is estimated to arrive at and/or pass said roadway crossing, the roadway vehicle's traveling thus potentially affecting the railway vehicle's traveling. Accordingly, with the sharing of information of the railway vehicle to the roadway vehicle and/or sharing of information of the roadway vehicle to the railway vehicle should the time windows at least partly overlap, the roadway vehicle and/or railway vehicle may respectively receive a heads-up regarding the presumed encounter and/or meet at the railway crossing. For that reason, an approach is provided for in an improved and/or alternative manner share information pertinent a railway crossing. The technical features and corresponding advantages of the above mentioned method will be discussed in further detail in the following.

By introducing a method performed by an information sharing system for sharing of information pertinent a railway crossing of a road and a railway, information related to said railway crossing may be communicated. "Sharing" of information may refer to "communication" of information, whereas "information" may refer to "traffic-related information" and/or "data". "Pertinent" a railway crossing may refer to "relevant for", "applicable for" and/or "associated with" a railway crossing, whereas railway crossing "of" a road and a railway may refer to a railway crossing "between" a road and a railway. Furthermore, the expression "railway" crossing may refer to "railroad" crossing, "level" crossing and/or "grade" crossing, whereas "crossing" may refer to "intersection". The road may cross and/or intersect the railway at said railway crossing at any arbitrary angle. Moreover, "road" may refer to any arbitrary road on which roadway vehicles—a.k.a. "road-bound vehicle"—may travel, whereas "railway" may refer to any arbitrary railway along which railway vehicles—a.k.a. rail-bound vehicles—may travel. The expression "roadway vehicle" may refer to any arbitrary commonly known vehicle, for instance an engine-propelled vehicle such as e.g. a car, truck, lorry, van, bus, tractor, and/or military vehicle, and may further optionally support partial and/or full autonomous driving. "Railway vehicle", on the other hand, may refer to any arbitrary rail-bound vehicle such as e.g. a train or a tram, which may be of arbitrary length and further may comprise any arbitrary number of wagons. The roadway vehicle may, as commonly known in the art, be adapted to communicate wirelessly with a remote roadway vehicles management system, as will be described further on. In a similar manner, the railway vehicle may, as commonly known in the art, be adapted to communicate wirelessly with a remote railways management system as will likewise be described further on. Moreover, the roadway vehicle may further be adapted to determine its geographical position and/or position data, as commonly known in the art, such as with support from one or more positioning systems and/or digital map data, and further to wirelessly provide said position and or position data—as commonly known—to said roadway vehicles management system. Similarly, the railway vehicle may further be adapted to determine its geographical position and/or position data such as with support from one or more positioning systems and/or digital map data, and further to wirelessly provide said position and or position data to said railway vehicles management system.

Since the information sharing system is associated with a roadway vehicles management system holding vehicle status data of one or more roadway vehicles, the information sharing system is in connection with a system adapted to wirelessly communicate directly or indirectly with roadway vehicles, derive and/or receive vehicle status data from the roadway vehicles, and hold information associated with the roadway vehicles such as said vehicle status data. The roadway vehicles management system may optionally further be adapted to remotely control functionality of the roadway vehicles, and may moreover for instance refer to commonly known Volvo On Call and/or an equivalent or successor thereof. The "information sharing system" may comprise and/or be comprised in one or more remote commonly known servers and/or "clouds"—also referred to as "automotive clouds" and/or "automotive cloud network"—adapted for storage and/or cloud-based storage and for wirelessly transmitting data to, and/or receiving data from, roadway vehicles. Additionally or alternatively, the information sharing system, and/or the one or more servers and/or clouds may further comprise, be comprised in, be connected to and/or be adapted to communicate with the roadway vehicles management system. The expression "associated with" may throughout this disclosure refer to "at least partly comprised in", "at least partly comprising", "in connection with" and/or "adapted to communicate with". Optionally, "holding vehicle status data of" may throughout refer to "supporting wireless communication with and vehicle status data retrieval from", whereas "wireless" communication throughout may refer to "cellular" and/or "wife" communication. Moreover, "wireless communication" may throughout refer to "wireless data communication". The expression "vehicle status data"—which throughout this disclosure may refer to "vehicle travel status data"—may for instance be represented by data associated with a geographical position of the corresponding vehicle, a travel direction of the vehicle, a travel velocity of the vehicle, etc. Moreover, vehicle status data "retrieval" may throughout refer to vehicle status data "reception" and/or "deriving".

Since the information sharing system derives—from the roadway vehicles management system—position-related data of a roadway vehicle along the road, there is established data of geographical whereabouts of at least one roadway vehicle with which the roadway vehicles management system as commonly known communicates and/or recently has been communicating and from which roadway vehicle the roadway vehicles management system has retrieved information on which said position-related data is based. The roadway vehicles management system may optionally have refined and/or interpreted said information to establish the position-related data. "Deriving" may throughout this disclosure refer to "retrieving", "receiving", "fetching", "downloading" and/or "deriving with support". Moreover, "data" may throughout refer to "information", whereas the expression "position-related" data throughout may refer to "travel-related data" such as data associated with the geographical position, travel direction, travel velocity, and/or planned travel itinerary etc. of the corresponding vehicle. Establishing whether the roadway vehicle is—and/or is assumed to be—positioned along said road, may be determined as commonly known in the art, for instance with support from digital map data.

Since the information sharing system determines—based on the roadway vehicle position-related data—a roadway vehicle timing at and/or during which the roadway vehicle is estimated to arrive at and/or cross the railway crossing, there is established a point in time and/or time period when the roadway vehicle is likely to reach and/or drive through the railway crossing. "Determining" may throughout this disclosure refer to "establishing", "calculating" and/or "predicting", whereas "based on" throughout may refer to "taking into account", "in view of" and/or "derived from". Moreover, "timing" may throughout refer to "point in time" and/or "time period", and may further refer to a time instant and/or a time span for instance ranging from a few seconds up to several minutes. "Estimated" may throughout refer to "assumed", "calculated", "expected" and/or "likely", whereas the expression "cross" the railway crossing may refer to "potentially cross" the railway crossing. Determining said roadway vehicle timing may be accomplished as commonly known in the art, for instance with support from digital map data.

Since the information sharing system derives—from a railway vehicles management system holding vehicle status data of one or more railway vehicles—position-related data of a railway vehicle along the railway, data of geographical whereabouts of at least one railway vehicle is retrieved from a system keeping track of one or more railway vehicles positioned along the railway, such as e.g. commonly known ERTMS ("European Rail Traffic Management System") or an equivalent or successor thereof. The railway vehicle in question may be a railway vehicle with which the railway vehicles management system, e.g. ERTMS, wirelessly communicates and/or recently has been communicating and from which railway vehicle the railway vehicles management system has retrieved information on which the position-related data may be based. Additionally or alternatively, the railway vehicles management system may have based said position-related data of the railway vehicle on information wirelessly retrieved as commonly known from one or more sensor devices positioned along the railway, which sensor devices may be adapted for sensing travel activity and/or whereabouts of railway vehicles along the railway. The roadway vehicles management system may optionally have refined and/or interpreted said information to establish the position-related data. Establishing whether the railway vehicle is—and/or is assumed to be—positioned along said railway, may be determined as commonly known in the art, for instance with support from digital map data and/or sensor data. Optionally, the expression of a railway vehicles management system "holding vehicle status data of" one or more railway vehicles, may additionally and/or alternatively refer to a railway vehicles management system "supporting wireless communication and vehicle status data retrieval of" one or more railway vehicles. The information sharing system may derive—e.g. receive and/or download—the railway vehicle position-related data directly from said railway vehicles management system, and/or indirectly via the optional automotive cloud network discussed above with which said railway vehicles management system then may be in—e.g. wireless—connection with.

Since the information sharing system determines—based on the railway vehicle position-related data—a railway vehicle timing at and/or during which the railway vehicle is estimated to arrive at and/or have passed the railway crossing, there is established a point in time and/or time period when the railway vehicle is likely to reach and/or have proceeded through the railway crossing. The expression "passed" the railway crossing may refer to "passed by" the railway crossing. Moreover, determining the railway vehicle timing may be accomplished as commonly known in the art.

Since the information sharing system determines—based on comparing a roadway vehicle time window comprising the roadway vehicle timing, to a railway vehicle time window comprising the railway vehicle timing—that the roadway vehicle time window at least partly overlaps the railway vehicle time window, a time range including the roadway vehicle timing is established to at least to some extent occur at the same point and/or period of time as a time range including the railway vehicle timing. The roadway vehicle time window represents a time range containing the roadway vehicle timing—i.e. the timing at and/or during which the roadway vehicle is estimated to arrive at and/or cross the railway crossing—optionally complemented with a time margin. Similarly, the railway vehicle time window represents a time range containing the railway timing—i.e. the timing at and/or during which the railway vehicle is estimated to arrive at and/or have passed the railway crossing—optionally complemented with a time margin. Respective vehicle time window may be set to any arbitrary time range considered an appropriate time margin and/or time buffer spanning over the corresponding vehicle timing, and may respectively and independently range for instance from a few seconds up to several minutes. For instance, should either vehicle timing be represented by e.g. 11:02, then the corresponding vehicle time window may range from exemplifying 11:01 to 11:04, exemplifying 11:00 to 11:03, exemplifying 11:00:30 to 11:02:30, or any other time range considered adequate. The length of time of either vehicle time window may optionally be predetermined. Moreover, optionally, the roadway vehicle time window may be equal or essentially equal to the roadway vehicle timing; similarly, the railway vehicle time window may be equal or essentially equal to the railway vehicle timing. The expression of a vehicle time window "comprising" may refer to a vehicle time window "including", "spanning over", "covering" and/or "containing". Moreover, the expression "at least partly" overlaps may refer to "at least to some extent" and/or "at least with one or more seconds" overlaps, whereas "overlaps" may refer to "overlaps with". The expression determining "based on comparing a roadway vehicle time window comprising said roadway vehicle timing, to a railway vehicle time window comprising said railway vehicle timing, that said roadway vehicle time window at least partly overlaps said railway vehicle time window", may refer to determining "when said roadway vehicle time window comprising said roadway vehicle timing, at least to some extent occurs at the same point and/or period of time as the railway vehicle time window comprising the said railway vehicle timing, that said roadway vehicle time window at least partly overlaps said railway vehicle time window". "When" may throughout this disclosure refer to "if" and/or "provided that".

Since the information sharing system provides information associated with the expected overlap to the roadway vehicle and/or to the railway vehicle, information related to and/or derived from the assumed time overlap is communicated to the roadway vehicle and/or the railway vehicle. Thereby, a roadway vehicle may receive information related to a railway vehicle presumably about to arrive at and/or pass a roadway crossing at a timing considered near a timing when said roadway vehicle is estimated to arrive at and/or cross said roadway crossing, the railway vehicle's traveling thus potentially affecting the roadway vehicle's traveling. Similarly, thereby, a railway vehicle may receive information related to a roadway vehicle presumably about to arrive at and/or cross a roadway crossing at a timing considered near a timing when said railway vehicle is estimated to arrive at and/or pass said roadway crossing, the roadway vehicle's traveling thus potentially affecting the railway vehicle's traveling. Accordingly, with the sharing of information of the railway vehicle to the roadway vehicle and/or sharing of information of the roadway vehicle to the railway vehicle should the time windows at least partly overlap, the roadway vehicle and/or railway vehicle may respectively receive a heads-up regarding the presumed encounter and/or meet at the railway crossing. "Providing" may refer to "transmitting", and furthermore to "wirelessly transmitting". Moreover, "providing" may throughout refer to "providing by means of said roadway vehicles management system and/or said railway vehicles management system", and further to "providing by wirelessly transmitting an information message". The "information" may throughout refer to "data", whereas the expression information "associated with" the expected overlap may refer to information "relevant in view of" the expected overlap. Moreover, the "expected" overlap may refer to "assumed", "likely", "calculated", "estimated" and/or "presumed" overlap. Optionally, information associated with "the expected overlap" may refer to information associated with "that said roadway vehicle time window at least partly overlaps said railway vehicle time window".

According to an example, the information associated with the expected overlap may comprise data initiating the roadway vehicle to, during at least semi-autonomous driving and/or full autonomous driving, perform a driving activity, an upcoming action and/or an upcoming manoeuvre—such as e.g. accelerating, decelerating and/or stopping—based on the railway vehicle position-related data, the railway vehicle timing and/or the railway vehicle time window. Thereby, the information sharing system provides the roadway vehicle with valuable information with regards to the expected encounter and/or meet with the railway vehicle at the upcoming railway crossing, which information may be utilized as input during partial and or full autonomous driving of the roadway vehicle.

Optionally, the information sharing system may determine—based on comparing the roadway vehicle position-related data to the railway vehicle position-related data—that the railway vehicle is estimated to be an object in range of one or more vision sensors of the roadway vehicle. The information associated with the expected overlap then comprises data based on the determination that the railway vehicle is estimated to be an object in range of one or more vision sensors of the roadway vehicle, which data initiates the roadway vehicle to classify the object as a railway vehicle. Thereby, since it is established from considering the roadway vehicle position-related data in view of the railway position-related data that the railway vehicle is assumed and/or expected to be an object viewable and/or observable by vision sensors—for instance rear-facing visions-sensors—of the roadway vehicle, and subsequently that the information associated with the expected overlap then holds data based thereon which initiates the roadway vehicle to classify said object as a railway vehicle, the information sharing system thus assists the roadway vehicle in establishing that said object in fact is a railway vehicle. That is, as commonly known, it may be challenging to—by means of one or more vision sensors on-board a roadway vehicle—classify an object in range of said vision sensors. It may prove difficult to estimate and/or determine the type and/or characteristics of said object—e.g. during unfavourable conditions—and hence challenging to estimate the severity of a potential impact with said object. Thus, with the information sharing system assisting the roadway vehicle in establishing that a potential object in range of one or more vision sensors of the roadway vehicle is a railway vehicle, the classification challenges mentioned above may be alleviated. A relevant situation may be a scenario where a railway vehicle such as e.g. a tram is traveling along a railway section that runs essentially in parallel with a road along which a roadway vehicle is traveling in essentially the same direction as—and for instance slightly ahead—of the railway vehicle, thus enabling the railway vehicle to be an object potentially in range of one or more—e.g. rear-facing—vision sensors of the roadway vehicle. In said scenario, the railway and/or the road then makes a turn such that the railway and road intersects at a railway crossing. Accordingly, with the introduced concept, since it is determined from comparing the roadway vehicle time window—at and/or during which the roadway vehicle is estimated to arrive at and/or cross the railway crossing—with the railway vehicle time window—at and/or during which the railway vehicle is estimated to arrive at and/or have passed the railway crossing—that said time windows at least partly overlap, and since it is further determined from comparing the roadway vehicle position-related data with the railway vehicle position-related data that the railway vehicle is estimated to be an object in range of the vision sensor(s) of the roadway vehicle, information initiating the roadway vehicle to classify the object as a railway vehicle is then provided to the roadway vehicle. Thus, the information sharing system assists the roadway vehicle in—prior to arriving at the railway crossing—classifying the observed object—here the railway vehicle—as a railway vehicle, thus avoiding the roadway vehicle potentially mistakably classifying the observed object for instance as a still-standing object and/or as an object—such as e.g. a tattered tarpaulin swirling around—with which impact is considered less severe and perhaps not considered worth braking or attempting to brake for. The assistance from the information sharing system in classification of the object as a railway vehicle, may especially be relevant should said roadway vehicle be a vehicle supporting at least semi-autonomous and/or fully autonomous driving. The expression that the railway vehicle "is estimated" an object in range, may refer to the railway vehicle "is assumed" and/or "likely is" an object in range. Furthermore, the expression determining "based on comparing said roadway vehicle position-related data to said railway vehicle position-related data", may refer to determining "when said roadway vehicle position-related data and said railway vehicle position-related data indicate that said railway vehicle potentially is within range of one or more vision sensors of said roadway vehicle". Moreover, an object "in range" may refer to an object "viewable" and/or "observable", whereas "vision sensors" may refer to "rear-facing vision sensors", "essentially rear-facing vision sensors" and/or "vision and/or radar sensors". Said vision sensors may be represented by vision sensors commonly known in the art, for instance supporting sensing by radar and/or being represented by one or more cameras. The expression of the information comprising "data" may throughout this disclosure refer to the information comprising "one or more instructions". Moreover, the expression of the data "initiating" may throughout refer to the data "prompting", "inspiring", "enabling", "influencing" and/or "instructing". "Classify" may refer to "determine".

Optionally, the information sharing system may determine—based on comparing the roadway vehicle position-related data to the railway vehicle position-related data—that the roadway vehicle is estimated to arrive at the railway crossing prior to the railway vehicle timing. The information associated with the expected overlap then comprises data based on the determination that the roadway vehicle is estimated to arrive at the railway crossing prior to the railway vehicle timing, which data initiates the roadway vehicle to, at the railway crossing, monitor the railway vehicle by means of one or more vision sensors. Thereby, since it is established from considering the roadway vehicle position-related data in view of the railway position-related data, that the roadway vehicle is expected to reach the railway crossing ahead of the railway vehicle timing i.e. ahead of the timing at and/or during which the railway vehicle is estimated to arrive at and/or have passed the railway crossing, and subsequently that the information associated with the expected overlap then holds data based thereon which initiates the roadway vehicle to, at the railway crossing, monitor the railway vehicle utilizing at least one vision sensor, the information sharing system thus enables the roadway vehicle to observe the railway vehicle as said railway vehicle passes the railway crossing. That is, the roadway vehicle is inquired to—by means of one or more vision sensors—monitor or attempt to monitor at least a portion of said railway vehicle, as said roadway vehicle is positioned at the railway crossing, for instance parked in wait for the railway vehicle to pass. The expression that the railway vehicle is "estimated" to arrive at the railway crossing prior to the railway vehicle timing may refer to that the vehicle is "expected", "calculated" and/or "assumed" to arrive at the railway crossing prior to the railway vehicle timing. Furthermore, the expression determining "based on comparing said roadway vehicle position-related data to said railway vehicle position-related data", may refer to determining "when said roadway vehicle position-related data and said railway vehicle position-related data indicate that said roadway vehicle timing is expected to occur prior to said railway vehicle timing". "At" the railway crossing may refer to "essentially at" and/or "in the vicinity of" the railway crossing, whereas "at the railway crossing" may refer to "at the railway crossing, when one or more forward-sensing vision sensors of said roadway vehicle has a favourable and/or an essentially unrestricted view in a direction of said railway crossing". "Monitor said railway vehicle" may refer to "observe and/or register said railway vehicle", "monitor at least a portion of said railway vehicle", "monitor said railway vehicle such that at least a first time instant at which said railway vehicle arrives at said railway crossing is detected and/or such that at least a second time instant at which said railway vehicle has passed said railway crossing is detected" and/or "monitor a passing time duration, a length and/or a velocity of said railway vehicle". Moreover, "vision sensors" may in this context refer to "forward-facing vision sensors" and/or "essentially forward-facing vision sensors". Said vision sensors may be represented by vision sensors commonly known in the art, for instance supporting sensing by radar and/or being represented by one or more cameras.

According to an example, the information sharing system may further:

receive monitored data of said railway vehicle, from said roadway vehicle; and provide monitoring information associated with said monitored data, to said railway vehicles management system, said monitoring information initiating said railway vehicles management system to utilize said monitored data to complement, update and/or refine said railway vehicle position-related data, for instance with regards to a position, a direction, a length and/or a velocity of said railway vehicle, and/or to update and/or refine an upcoming railway vehicle time window.

Thereby, since monitored data of the railway vehicle then is received from the roadway vehicle, information related to the railway vehicle captured by the one or more vision sensors of the roadway vehicle, is received by the information sharing system. The monitored data may for instance be received via the roadway vehicles management system, and/or via the optional automotive cloud network discussed above. Moreover, thereby, since monitoring information associated with the monitored data is provided to the railway vehicles management system, which monitoring information initiates the railway vehicle management system to utilize the monitored data to complement, update and/or refine the railway vehicle position-related data and/or to update and/or refine an upcoming railway vehicle time window, the information sharing system assists the railway vehicles management system in keeping data stored therein associated with the railway vehicle, up-to-date. The monitoring information may for instance be provided to the railway vehicles monitoring system via the optional automotive cloud network discussed above.

Optionally, the railway crossing may at least partly comprise an active protection system with one or more level crossing barriers and/or gates adapted to be lowered, and/or one or more level crossing signs adapted to provide a warning, during a no-passage time window associated with the railway vehicle timing. The information sharing system then derives time information of the no-passage time window from the railway vehicles management system. The information associated with the expected overlap then comprises data based on the time information, which data initiates the roadway vehicle to take into account—and/or present visually and/or audibly—time to expiry of the no-passage time window. Thereby, since the railway crossing at least partly comprises an active protection system with one or more level crossing barriers and/or gates adapted to be lowered, and/or one or more level crossing signs adapted to provide a warning, during a no-passage time window associated with the railway vehicle timing, said railway crossing is provided with a commonly known protecting system prohibiting surrounding roadway vehicles from crossing—and/or warning surrounding roadway vehicles of crossing—the railway crossing during a period of time. Moreover, thereby, since time information of the no-passage time window is derived from the railway vehicles management system, the information sharing system is made aware of said no-passage time window. The time information may for instance be derived—e.g. received—via the optional automotive cloud network discussed above. Furthermore, thereby, since the information associated with the expected overlap then comprises data based on the time information, which data initiates the roadway vehicle to take into account—and/or present visually and/or audibly—time to expiry of the no-passage time window, the information sharing system enables the roadway vehicle to base one or more upcoming actions, such as e.g. accelerating, decelerating and/or stopping, on said time to expiry—for instance in the scenario of a roadway vehicle supporting at least semi- and/or fully autonomous driving—and/or to indicate to a potential driver time remaining of the no-passage time window, for instance by means of one or more displays and/or loudspeakers on-board said roadway vehicle. "Time to expiry" may throughout refer to "time to green ("TTG")".

Optionally, the information sharing system may further determine—based on comparing the roadway vehicle position-related data to the no-passage time window, that the roadway vehicle is crossing and/or has already crossed the railway crossing prior to expiry of the no-passage time window. The information sharing system then provides data based on that the roadway vehicle is crossing and/or has already crossed the railway crossing prior to expiry of the no-passage time window, to the railway vehicles management system, the railway vehicle, the roadway vehicles management system and/or the roadway vehicle, which data reveals a violation of the one or more level crossing barriers and/or level crossing signs. Thereby, since—from comparison of the roadway vehicle position-related data with the no-passage time window—it is determined that the roadway vehicle is crossing and/or has already crossed the railway crossing prior to expiry of the no-passage time window, the information sharing system may conclude misuse by the roadway vehicle of the one or more level crossing barriers and/or level crossing signs. The expression determining "based on comparing said roadway vehicle position-related data to said no-passage time window" may refer to determining "when said roadway vehicle position-related data indicates that said roadway vehicle is on the railway and/or on the other side of the railway crossing prior to expiry of said no-passage time window". Furthermore, "a violation" may refer to "a misuse" and/or "misuse". Moreover, thereby, since data based on that the roadway vehicle is crossing and/or has already crossed the railway crossing prior to expiry of the no-passage time window then is provided to the railway vehicles management system, the railway vehicle, the roadway vehicles management system and/or the roadway vehicle, which data reveals a violation of the one or more level crossing barriers and/or level crossing signs, the information sharing system assists in communicating the misuse. At the receiving end, one or more appropriate actions may be taken based thereon, such as for instance the railway vehicles management system gathering violation statistics related to the railway crossing in question. The data revealing a violation of the one or more level crossing barriers and/or level crossing signs, may for instance be provided to the railway vehicles management system via the optional automotive cloud network discussed above.

Optionally, the railway crossing may at least partly be unprotected. The information associated with the expected overlap then comprises data based on the railway vehicle time window, which data initiates the roadway vehicle to take into account—and/or present an in-vehicle visual and/or audible indication until—the expiry of the railway vehicle time window. Thereby, since the railway crossing at least partly is unprotected, the railway crossing is at least to some extent unattended, i.e. at least to some extent lacks an active protection system. "Unprotected" may refer to "passive". Moreover, thereby, since the information associated with the expected overlap comprises data based on the railway vehicle time window, which data initiates the roadway vehicle to take into account—and/or present an in-vehicle visual and/or audible indication until—the expiry of the railway vehicle time window, the information sharing system enables the roadway vehicle to base one or more upcoming actions, such as e.g. how long to remain at and/or when to cross said railway crossing, on said expiry of the railway vehicle time window—for instance in the scenario of a roadway vehicle supporting at least semi-autonomous and/or fully autonomous driving—and/or to indicate to a potential driver time remaining of the railway vehicle time window, for instance by means of one or more displays and/or one or more loudspeakers on-board said roadway vehicle.

According to an example, the data based on the railway vehicle time window may further initiate the roadway vehicle to issue a warning, and/or present an in-vehicle visual and/or audible warning, when the roadway vehicle crosses and/or attempts to cross the railway crossing prior to expiry of the railway vehicle time window. Thereby, the information sharing system enables the roadway vehicle—for instance in the scenario of a roadway vehicle supporting at least semi-autonomous and/or fully autonomous driving—to learn of that said railway crossing is crossed prematurely, and/or to indicate that said railway crossing is crossed prematurely to a potential driver, for instance by means of one or more displays and/or one or more loudspeakers on-board said roadway vehicle.

Optionally, the information sharing system may estimate, based on the roadway vehicle position-related data, that the roadway vehicle at least partly is positioned on the railway at the railway crossing. The information sharing system then further derives—from the roadway vehicles management system—hazard light data indicative of whether or not a hazard light alert is active or not on the roadway vehicle. Additionally or alternatively, the information sharing system derives a confidence value indicating a level of general confidence of position-related data in a geographical area at least partly comprising the railway crossing, which confidence value is based on statistical position-related data in said area. The information sharing system further determines that the hazard light data indicates that the hazard light alert is active, and/or that the confidence value exceeds a pre-determined minimum confidence level threshold. The information associated with the expected overlap then comprises data based on the estimating that the roadway vehicle is at least partly positioned on the railway at the railway crossing and based on the deriving of the hazard light data or the deriving of the confidence value, which data reveals a potential collision hazard at the railway crossing between the roadway vehicle and the railway vehicle. Thereby, since it is estimated based on the roadway vehicle position-related data that the roadway vehicle at least partly is positioned on the railway at the railway crossing, the information sharing system identifies a risk situation in that the roadway vehicle potentially is positioned on the railway. Moreover, thereby, since hazard light data is derived from the roadway vehicles management system which hazard light data is indicative of whether or not a commonly known hazard light alert is active or not on the roadway vehicle, the information sharing system may learn of the hazard light status of the roadway vehicle in a commonly known manner. Moreover, thereby, since a confidence value additionally or alternatively is derived, which confidence value indicates a level of general confidence of position-related data in a geographical area at least partly comprising the railway crossing, and which confidence value is based on statistical position-related data in said area, the information sharing system may learn based on statistical data for said geographical area to what extent the roadway vehicle position-related data—which indicates that the roadway vehicle at least partly is positioned on the railway—is reliable. "Deriving" a confidence value may refer to "determining" a confidence value", whereas "statistical" position-related data may refer to "statistical verified", "previously verified" and/or "historical" position-related data. Moreover, thereby, since it is determined that the hazard light data indicates that the hazard light alert is active, and/or that the confidence value exceeds a pre-determined minimum confidence level threshold, and the information associated with the expected overlap then comprises data based on the estimating that the roadway vehicle is at least partly positioned on the railway at the railway crossing and based on the deriving of the hazard light data or the deriving of the confidence value, which data reveals a potential collision hazard at the railway crossing between the roadway vehicle and the railway vehicle, the information sharing system informs the roadway vehicle and/or the railway vehicle of the potential collision hazard when learning that the hazard light alert is active on the roadway vehicle and/or when the confidence value indicates that the roadway vehicle indeed appears to be positioned on the railway.

According to an example, the information sharing system may further:

derive from said railway vehicles management system, position-related data of a second railway vehicle along said railway;

determine a second railway vehicle timing at and/or during which said second railway vehicle is expected to arrive at and/or have passed said railway crossing; and determine, based on comparing the roadway vehicle time window to a second railway vehicle time window comprising said second railway vehicle timing, that said roadway vehicle time window at least partly overlaps said second railway vehicle time window;

wherein said providing information associated with the expected overlap then further comprises:

providing information associated with the second expected overlap, to said roadway vehicle and/or to said railway vehicle.

Thereby, the roadway vehicle may receive information related to as well as second railway vehicle presumably about to arrive at and/or pass a roadway crossing at a timing considered near a timing when said roadway vehicle is estimated to arrive at and/or cross said roadway crossing, the second railway vehicle's traveling thus potentially affecting the roadway vehicle's traveling.

According to a second embodiment herein, the object is achieved by an information sharing system adapted for sharing of information pertinent a railway crossing of a road and a railway, which information sharing system is associated with a roadway vehicles management system holding vehicle status data of one or more roadway vehicles. The information sharing system comprises a roadway deriving unit adapted for deriving from the roadway vehicles management system, position-related data of a roadway vehicle along the road, as well as a roadway determining unit adapted for determining, based on the roadway vehicle position-related data, a roadway vehicle timing at and/or during which the roadway vehicle is estimated to arrive at and/or cross the railway crossing. The information sharing system further comprises a railway deriving unit adapted for deriving from a railway vehicles management system holding vehicle status data of one or more railway vehicles, position-related data of a railway vehicle along the railway, as well as a railway determining unit adapted for determining, based on the railway vehicle position-related data, a railway vehicle timing at and/or during which the railway vehicle is estimated to arrive at and/or have passed the railway crossing. Moreover, the information sharing system comprises a time window determining unit adapted for determining—based on comparing a roadway vehicle time window comprising the roadway vehicle timing, to a railway vehicle time window comprising the railway vehicle timing—that the roadway vehicle time window at least partly overlaps the railway vehicle time window. The information sharing system further comprises an information providing unit adapted for providing information associated with the expected overlap, to the roadway vehicle and/or to the railway vehicle.

Optionally, the information sharing system may further comprise a range determining unit adapted for determining based on comparing the roadway vehicle position-related data to the railway vehicle position-related data, that the railway vehicle is estimated to be an object in range of one or more vision sensors of the roadway vehicle. The information associated with the expected overlap then comprises data based on the comparing the roadway vehicle position-related data to the railway vehicle position-related data, which data initiates the roadway vehicle to classify the object as a railway vehicle.

Moreover, optionally, the information sharing system may further comprise an arrival determining unit adapted for determining based on comparing the roadway vehicle position-related data to the railway vehicle position-related data, that the roadway vehicle is estimated to arrive at the railway crossing prior to the railway vehicle timing. The information associated with the expected overlap then comprises data based on the comparing the roadway vehicle position-related data to the railway vehicle position-related data, which data initiates the roadway vehicle to, at the railway crossing, monitor the railway vehicle by means of one or more vision sensors.

Furthermore, optionally, the railway crossing may at least partly comprise an active protection system with one or more level crossing barriers and/or gates adapted to be lowered, and/or one or more level crossing signs adapted to provide a warning, during a no-passage time window associated with the railway vehicle timing. The information sharing system then further comprises a no-passage deriving unit adapted for deriving time information of the no-passage time window from the railway vehicles management system. The information associated with the expected overlap then comprises data based on the time information, which data initiates the roadway vehicle to take into account—and/or present visually and/or audibly—time to expiry of the no-passage time window. Optionally, the information sharing system may then further comprise a violation crossing determining unit adapted for determining based on comparing the roadway vehicle position-related data to the no-passage time window, that the roadway vehicle is crossing and/or has already crossed the railway crossing prior to expiry of the no-passage time window, and a violation providing unit adapted for providing data based on the determination, to the railway vehicles management system, the railway vehicle, the roadway vehicles management system and/or the roadway vehicle, which data reveals a violation of the one or more level crossing barriers and/or level crossing signs.

Optionally, the railway crossing may at least partly be unprotected. The information associated with the expected overlap then comprises data based on the railway vehicle time window, which data initiates the roadway vehicle to take into account—and/or present an in-vehicle visual and/or audible indication until—the expiry of the railway vehicle time window.

Moreover, optionally, the information sharing system may further comprise a railway position estimating unit adapted for estimating based on the roadway vehicle position-related data that the roadway vehicle at least partly is positioned on the railway at the railway crossing. The information sharing system then further comprises a hazard light deriving unit adapted for deriving from the roadway vehicles management system, hazard light data indicative of whether or not a hazard light alert is active or not on the roadway vehicle. Additionally or alternatively, the information sharing system comprises a confidence value deriving unit adapted for deriving a confidence value indicating a level of general confidence of position-related data in a geographical area at least partly comprising the railway crossing, which confidence value is based on statistical position-related data in the area. The information sharing system further comprises a hazard determining unit adapted for determining that the hazard light data indicates that the hazard light alert is active, and/or that the confidence value exceeds a predetermined minimum confidence level threshold. The information associated with the expected overlap then comprises data based on the estimating that the roadway vehicle is at least partly positioned on the railway and based on the deriving of hazard light data and/or the deriving of a confidence value, which data reveals a potential collision hazard at the railway crossing between the roadway vehicle and the railway vehicle.

Similar advantages as those mentioned in the foregoing in relation to the first embodiment correspondingly apply to the second, which is why these advantages are not further discussed.

According to a third embodiment herein, the object is achieved by a computer program product comprising a computer program containing computer program code means arranged to cause a computer or a processor to execute the steps of the information sharing system discussed above, stored on a computer-readable medium or a carrier wave. Yet again, similar advantages as those mentioned in the foregoing in relation to the first embodiment correspondingly apply to the third, which is why these advantages are not further discussed.

BRIEF DESCRIPTION OF THE DRAWINGS

The various non-limiting embodiments of the disclosure, including particular features and advantages, will be readily understood from the following detailed description and the accompanying drawings, in which.

DETAILED DESCRIPTION

Figure 1:
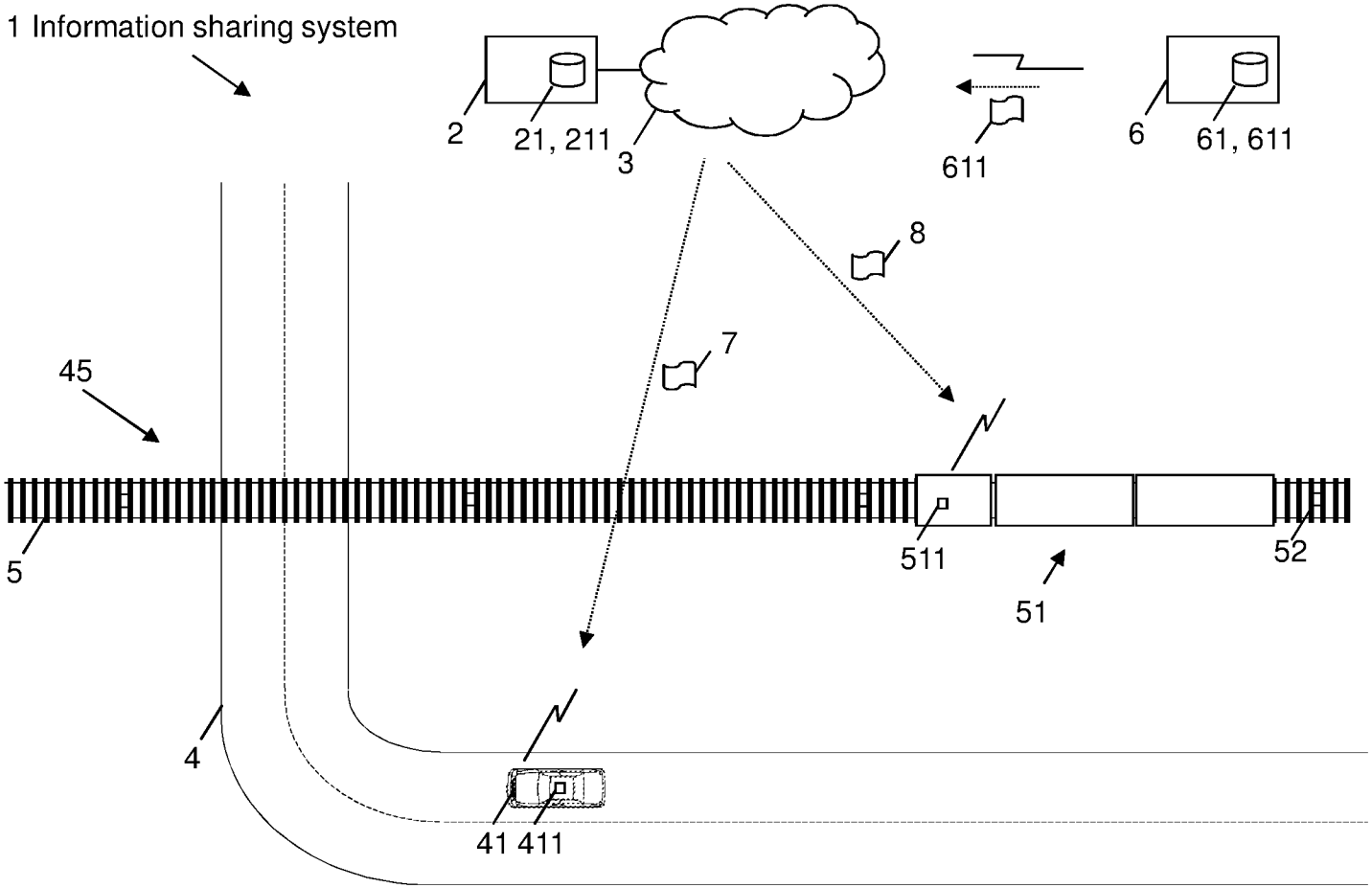
FIG. 1 illustrates a schematic overview of an exemplifying information sharing system according to embodiments of the disclosure.

As required, detailed embodiments are disclosed herein. However, it is to be understood that the disclosed embodiments are merely exemplary and that various and alternative forms may be employed. The figures are not necessarily to scale. Some features may be exaggerated or minimized to show details of particular components. Therefore, specific structural and functional details disclosed herein are not to be interpreted as limiting, but merely as a representative basis for teaching one skilled in the art.

The non-limiting embodiments of the present disclosure will now be described more fully hereinafter with reference to the accompanying drawings. This disclosure may, however, be embodied in many different forms and should not be construed as limited to the embodiments set forth herein. Like reference characters refer to like elements throughout. Dashed lines of some boxes in the figures indicate that these units or actions are optional and not mandatory. Reference characters followed by one or more apostrophes in FIGS. 2-7 refer to elements resembling elements previously discussed in conjunction with FIG. 1.

In the following, according to embodiments herein which relate to sharing of information pertinent a railway crossing of a road and a railway, there will be disclosed an approach which enables information related to said railway crossing to be communicated.

Referring now to the figures and FIG. 1 in particular, there is illustrated a schematic overview of an exemplifying information sharing system 1 according to embodiments of the disclosure. The information sharing system 1 is associated with a roadway vehicles management system 2 holding vehicle status data 21 of one or more roadway vehicles. The information sharing system 1 and the roadway vehicles management system 2 are here connected to an automotive cloud network 3. Further shown is a road 4 along which a roadway vehicle 41 is positioned. The roadway vehicle 41 here comprises a commonly known positioning system 411 for positioning thereof. The roadway vehicle 41 is further adapted for wireless communication with the roadway vehicles management system 2, which enables the roadway vehicle status data 21 to comprise position-related data 211 of the shown roadway vehicle 41. Additionally, shown is a railway 5 along which a railway vehicle 51 is positioned, and a railway vehicles management system 6 that holds vehicle status data 61 of one or more railway vehicles. The railway vehicle 51 here comprises a commonly known positioning system 511 for positioning thereof; optionally, the railway 5 may additionally or alternatively comprise and/or be equipped with one or more sensors 52 adapted to sense the presence of the railway vehicle 51. The railway vehicle 51 is further adapted for wireless communication with a railway vehicles management system 6, which enables the railway vehicle status data 61 to comprise position-related data 611 of the shown railway vehicle 51. Additionally or alternatively may the one or more optional sensors 52 enable the railway vehicle status data 61 to comprise the railway vehicle position-related data 611. The road 4 and the railway 5 intersect at a railway crossing 45. Further shown is information 7 provided to the roadway vehicle 41, here referred to as roadway vehicle provided information, and information 8 provided to the railway vehicle 51, here referred to as railway vehicle provided information.

Figure 2:
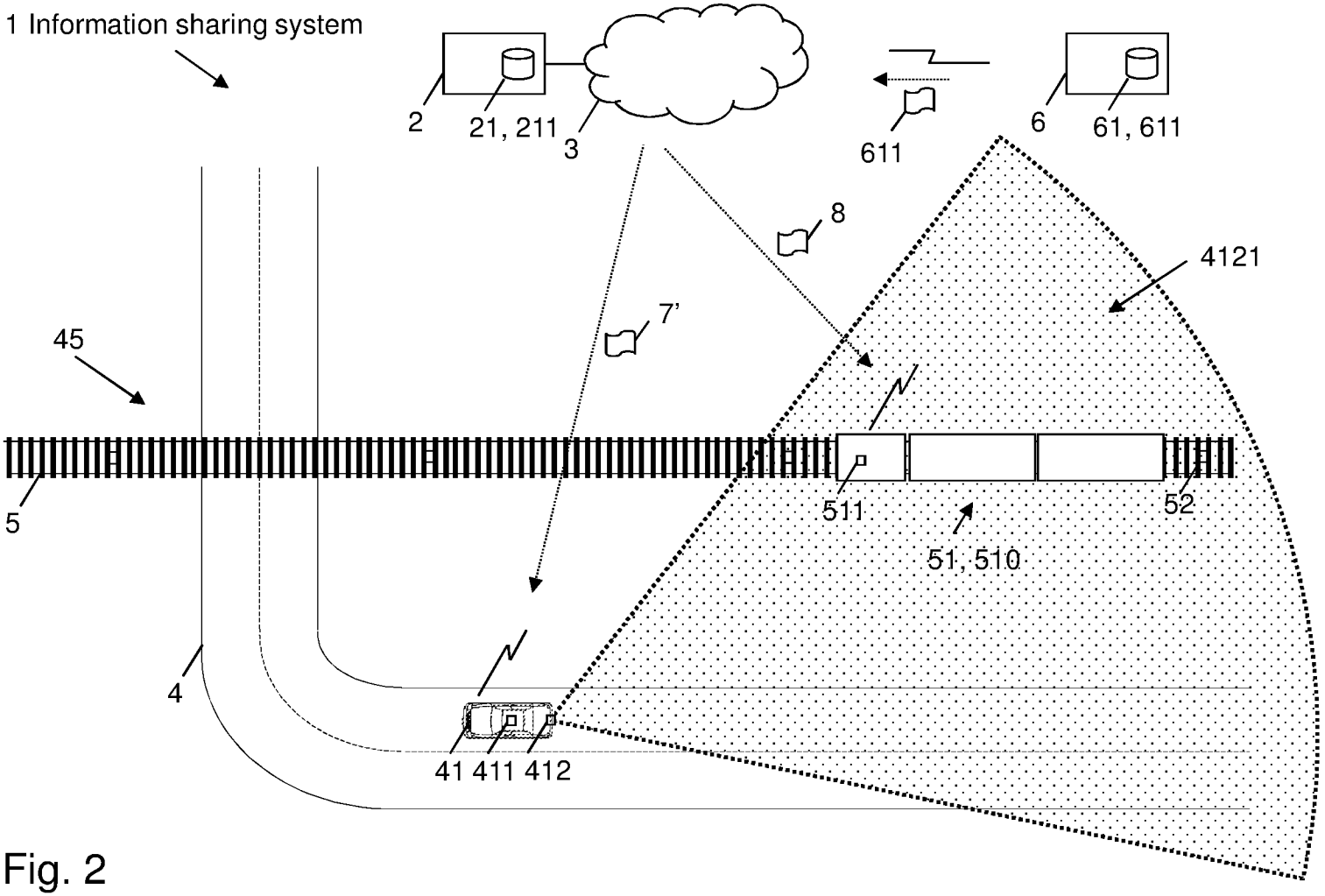
FIG. 2 illustrates a schematic overview of an exemplifying information sharing system according to embodiments of the disclosure, when the railway vehicle is estimated to be an object in range of one or more vision sensors of the roadway vehicle.

FIG. 2 illustrates a schematic overview of an exemplifying information sharing system 1 according to embodiments of the disclosure, when the railway vehicle 51 is estimated to be an object 510 in range 4121 of one or more optional vision and/or radar sensors 412 of the roadway vehicle 41. The roadway vehicle provided information 7' may then comprise data initiating the roadway vehicle 41 to classify the object 510 as a railway vehicle, as will be further discussed in conjunction with FIG. 9.

Figure 3:
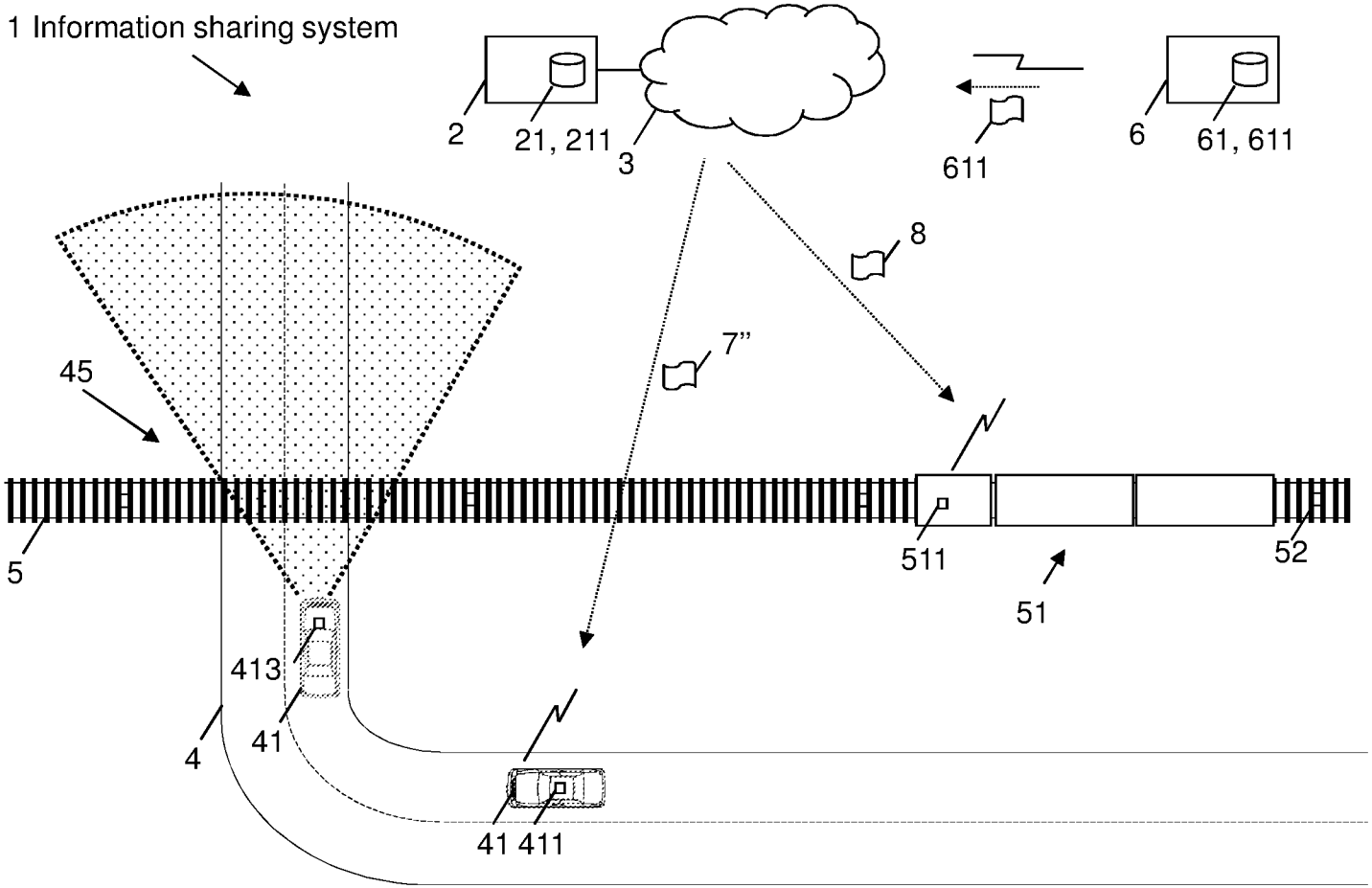
FIG. 3 illustrates a schematic overview of an exemplifying information sharing system according to embodiments of the disclosure, when the roadway vehicle is estimated to arrive at the railway crossing prior to the railway vehicle timing.

FIG. 3 illustrates a schematic overview of an exemplifying information sharing system 1 according to embodiments of the disclosure, when the roadway vehicle 41 is estimated to arrive at the railway crossing 45 prior to a railway vehicle timing. The roadway vehicle provided information 7" may then comprise data initiating the roadway vehicle 41 to, at the railway crossing 45, monitor the railway vehicle 51 by means of one or more vision and/or radar sensors 413, as will be further discussed in conjunction with FIG. 9.

Figure 4:
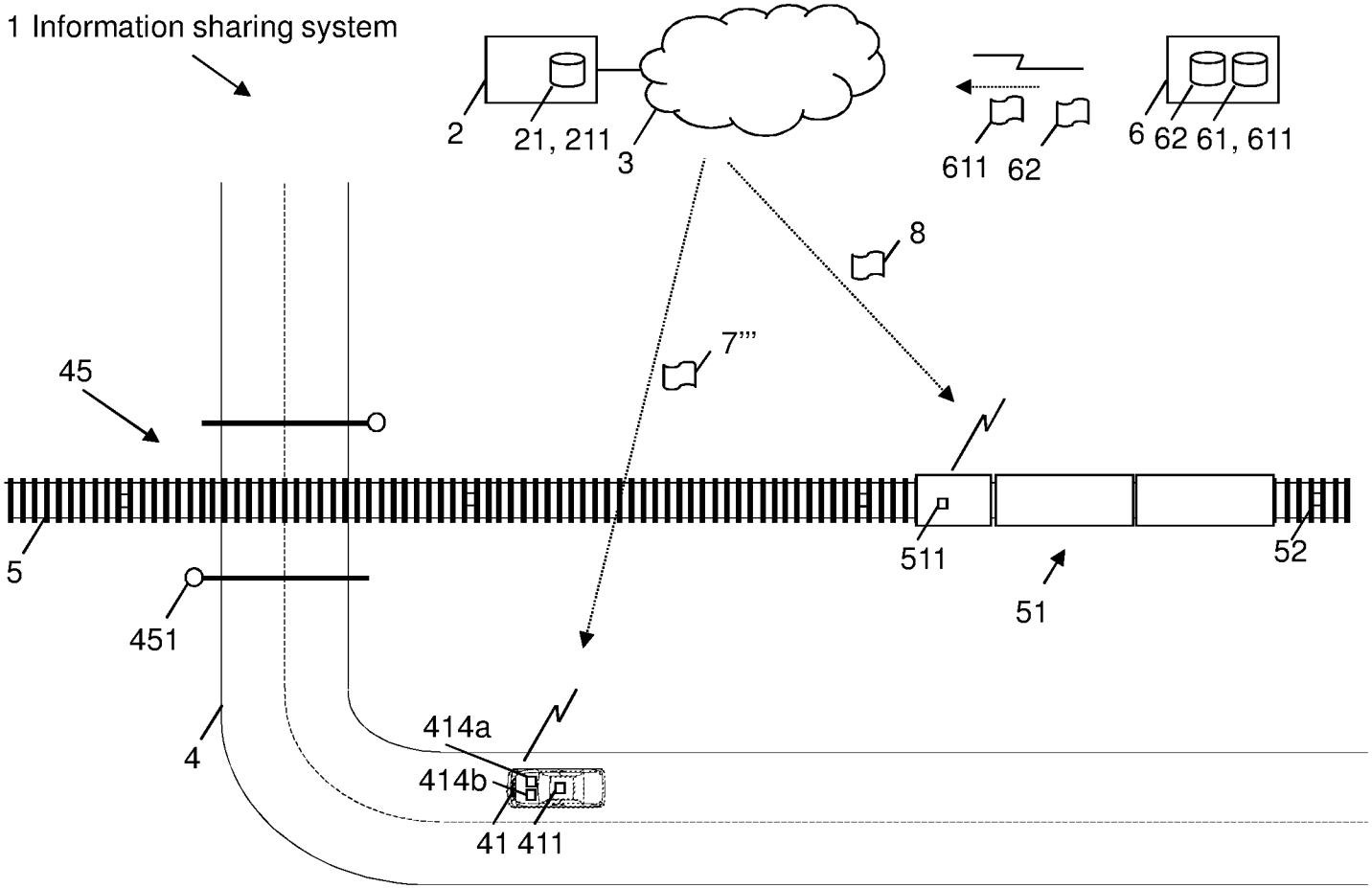
FIG. 4 illustrates a schematic overview of an exemplifying information sharing system according to embodiments of the disclosure, when the railway crossing at least partly comprises an active protection system.

FIG. 4 illustrates a schematic overview of an exemplifying information sharing system 1 according to embodiments of the disclosure, when the railway crossing 45 at least partly comprises an active protection system 451. The active protection system 451 is here represented by level crossing barriers adapted to be lowered during a no-passage time window. Further shown is time information 62 of the no-passage time window derived from the railway vehicles management system 6. The roadway vehicle provided information 7''' may then comprise data initiating the roadway vehicle 41 to take into account—and/or present visually and/or audibly e.g. by means of one or more displays 414*a* and or loudspeakers 414*b* on-board the roadway vehicle 41—time to expiry of the no-passage time window, as will be further discussed in conjunction with FIG. 9.

Figure 5:
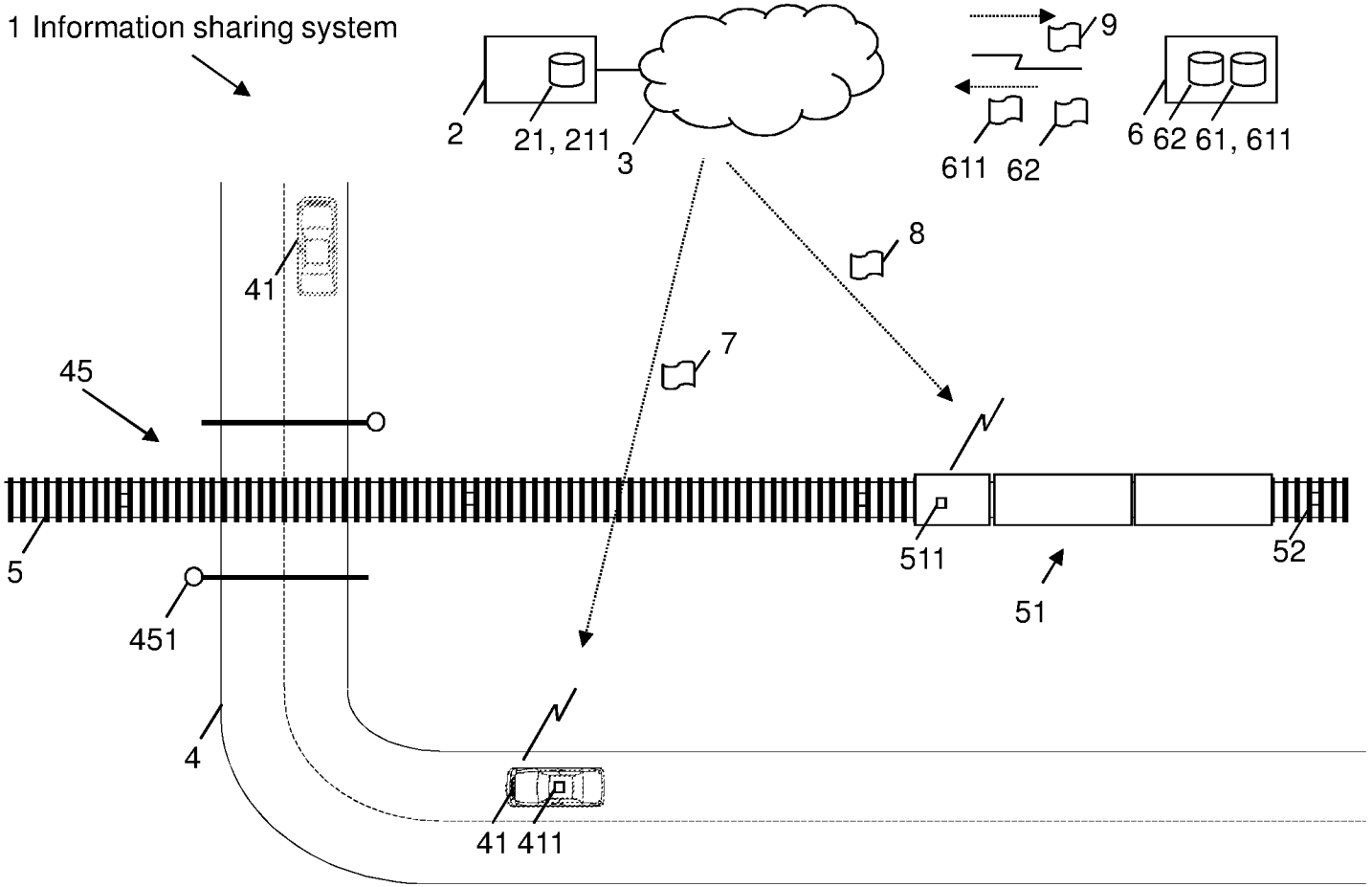
FIG. 5 illustrates a schematic overview of an alternative exemplifying information sharing system according to embodiments of the disclosure, when the railway crossing at least partly comprises an active protection system.

FIG. 5 illustrates a schematic overview of an alternative exemplifying information sharing system 1 according to embodiments of the disclosure, when the railway crossing 45 at least partly comprises an active protection system 451. The active protection system 451 is here represented by level crossing barriers adapted to be lowered during a no-passage time window. Further shown is time information 62 of the no-passage time window derived from the railway vehicles management system 6. Here, the roadway vehicle 41 has already crossed the railway crossing 45 prior to expiry of the no-passage time window. Still further shown is data 9 provided to the railway vehicles management system 6, which data reveals a violation of the one or more level crossing barriers 451, as will be further discussed in conjunction with FIG. 9.

Figure 6:
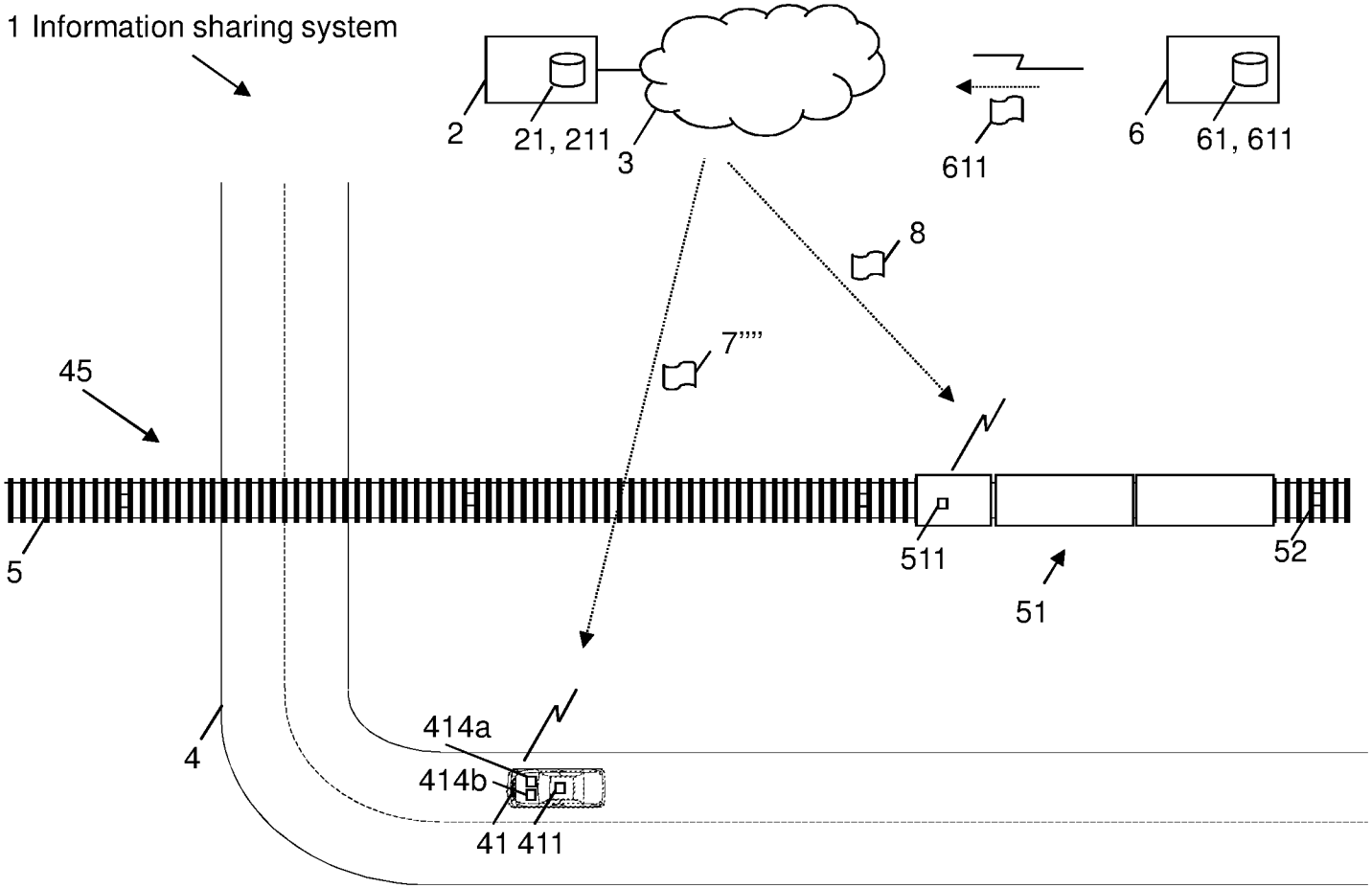
FIG. 6 illustrates a schematic overview of an exemplifying information sharing system according to embodiments of the disclosure, when the railway crossing at least partly is unprotected.

FIG. 6 illustrates a schematic overview of an exemplifying information sharing system 1 according to embodiments of the disclosure, when the railway crossing 45 at least partly is unprotected. The roadway vehicle provided information 7'''' may then comprise data initiating the roadway vehicle 41 to take into account—and/or present an in-vehicle visual and/or audible indication e.g. by means of one or more displays 414*a* and or loudspeakers 414*b* on-board the roadway vehicle 41 until—the expiry of a railway vehicle time window, as will be further discussed in conjunction with FIG. 9.

Figure 7:
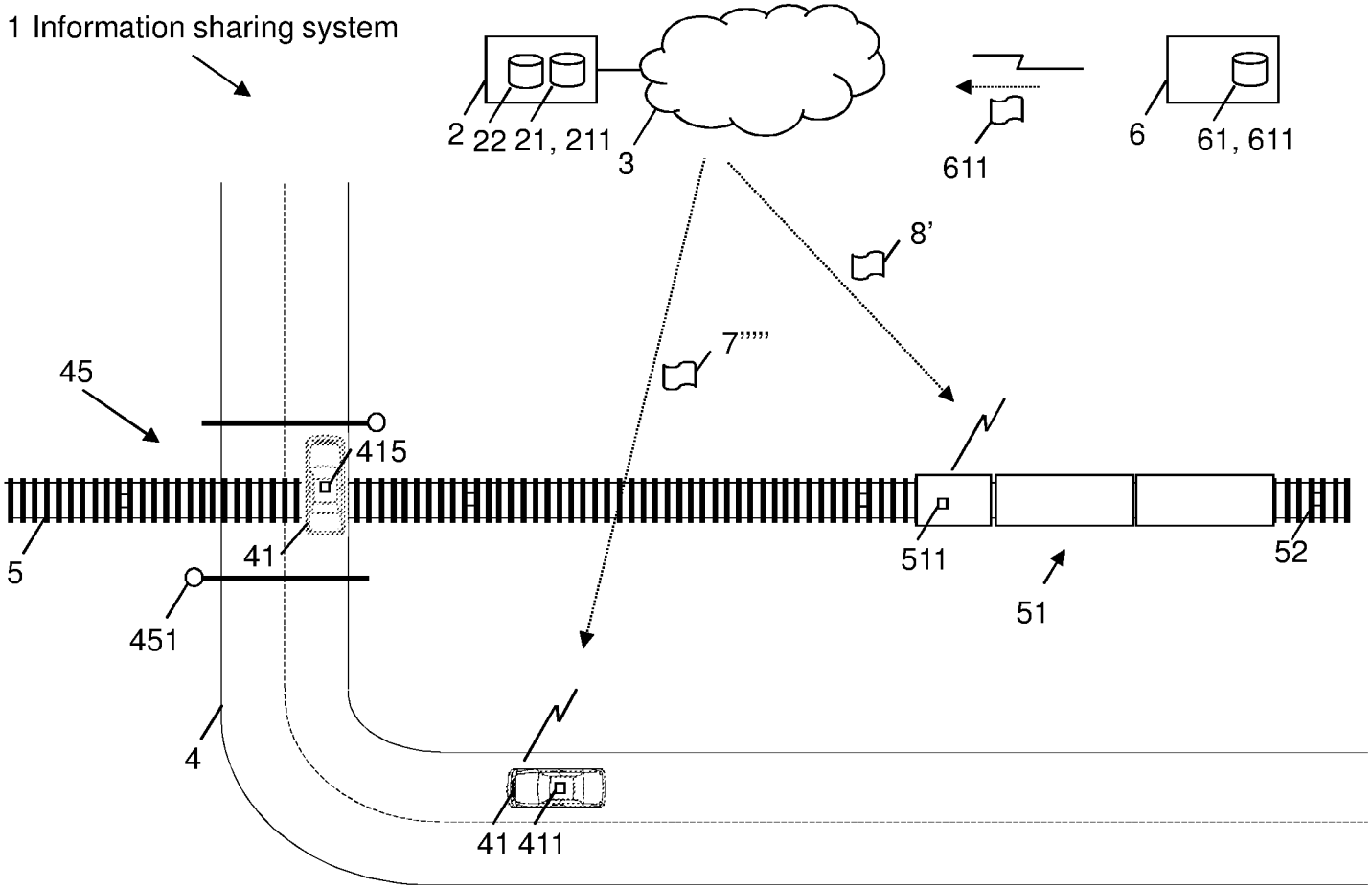
FIG. 7 illustrates a schematic overview of an exemplifying information sharing system according to embodiments of the disclosure, when the roadway vehicle appears to at least partly be positioned on the railway at the railway crossing.

FIG. 7 illustrates a schematic overview of an exemplifying information sharing system 1 according to embodiments of the disclosure, when the roadway vehicle 41 appears to at least partly be positioned on the railway 5 at the railway crossing 45. Further shown is hazard light data 22 derived from the roadway vehicles management system 2, which hazard light data 22 is indicative of whether or not a hazard light alert 415 is active or not on the roadway vehicle 41; here, the hazard light alert 415 is active. The roadway vehicle provided information 7''''' and/or the railway vehicle provided information 8' may then comprise data revealing a potential collision hazard at the railway crossing 45 between the roadway vehicle 41 and the railway vehicle 51, as will be further discussed in conjunction with FIG. 9.

As further shown in FIG. 8, which depicts a schematic block diagram illustrating an exemplifying information sharing system 1 according to embodiments of the disclosure, the information sharing system 1 comprises a roadway deriving unit 101, a roadway determining unit 102, a railway deriving unit 103, a railway determining unit 104, a time window determining unit 105 and an information providing unit 113, all of which will be described in greater detail further on in the description. The information sharing system 1 may further comprise an optional range determining unit 106, an optional arrival determining unit 107, an optional no-passage deriving unit 108, an optional violation crossing determining unit 114, an optional violation providing unit 115, an optional railway position estimating unit 109, an optional hazard light deriving unit 110, an optional confidence value deriving unit 111, and/or an optional hazard determining unit 112, which similarly will be described in greater detail further on.

Furthermore, the embodiments herein for sharing of information pertinent a railway crossing 45 of a road 4 and a railway 5, may be implemented through one or more processors, such as a processor 116, here denoted CPU, together with computer program code for performing the functions and actions of the embodiments herein. Said program code may also be provided as a computer program product, for instance in the form of a data carrier carrying computer program code for performing the embodiments herein when being loaded into the information sharing system 1. One such carrier may be in the form of a CD ROM disc. It is however feasible with other data carriers such as a memory stick. The computer program code may furthermore be provided as pure program code on a server and downloaded to the information sharing system 1. The information sharing system 1 may further comprise a memory 117 comprising one or more memory units. The memory 117 may be arranged to be used to store e.g. information, and further to store data, configurations, schedulings, and applications, to perform the methods herein when being executed in the information sharing system 1. Furthermore, the units 101-115 discussed above, the processor 116 may and the memory 117 may for instance fully or at least partly be implemented in the optional automotive cloud network 3 and/or the roadway vehicles management system 2. Those skilled in the art will also appreciate that the units 101-115 discussed above, which will be described in further detail later on in this description, as well as any other system, unit, arrangement, device, module, or the like described herein, may refer to a combination of analog and digital circuits, and/or one or more processors configured with software and/or firmware, e.g. stored in a memory such as the memory 117, that when executed by the one or more processors such as the processor 116 perform as will be described in more detail later on. One or more of these processors, as well as the other digital hardware, may be included in a single ASIC (Application-Specific Integrated Circuitry), or several processors and various digital hardware may be distributed among several separate components, whether individually packaged or assembled into a SoC (System-on-a-Chip).

Figure 8:
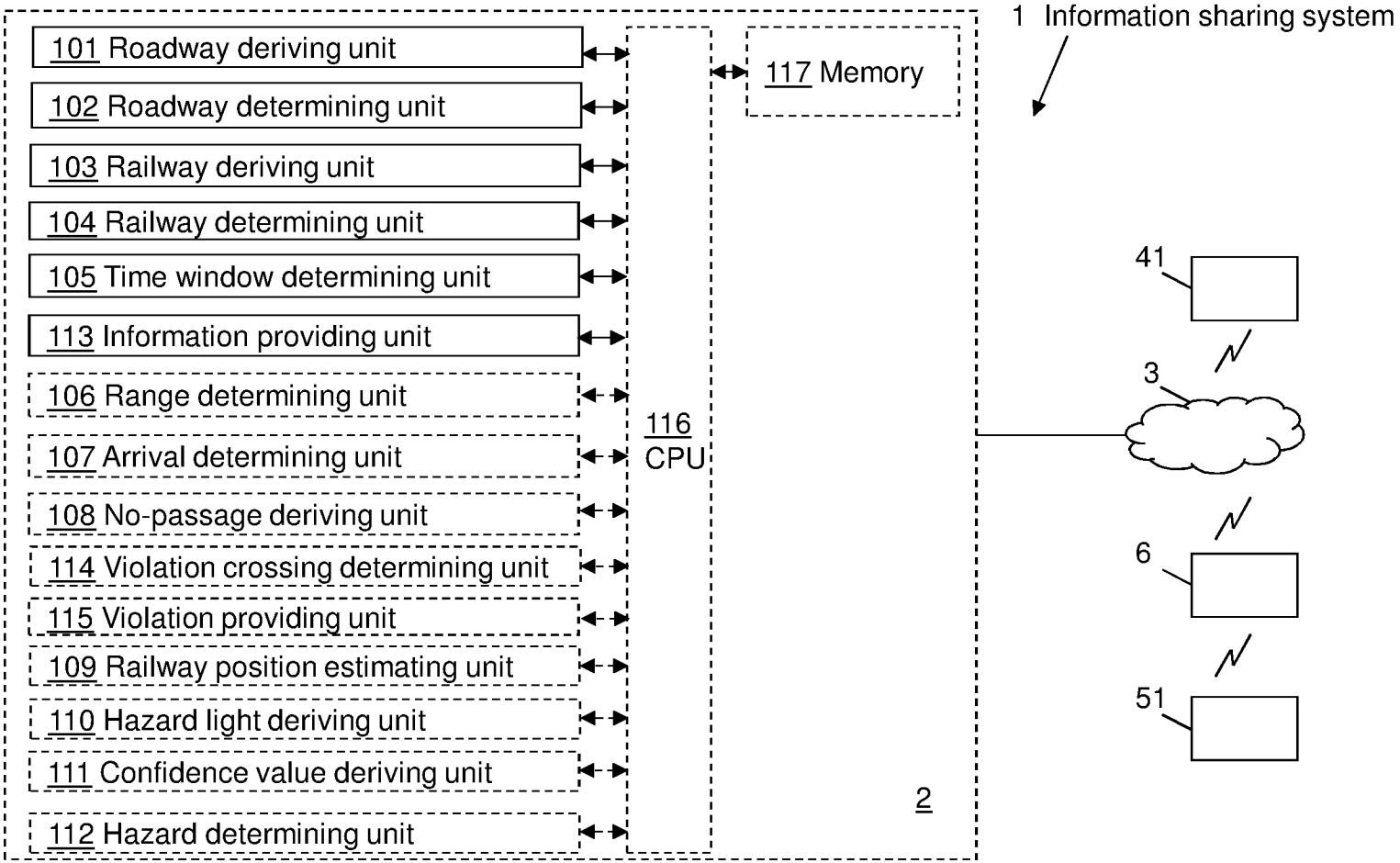
FIG. 8 is a schematic block diagram illustrating an exemplifying information sharing system according to embodiments of the disclosure.
Figure 9:
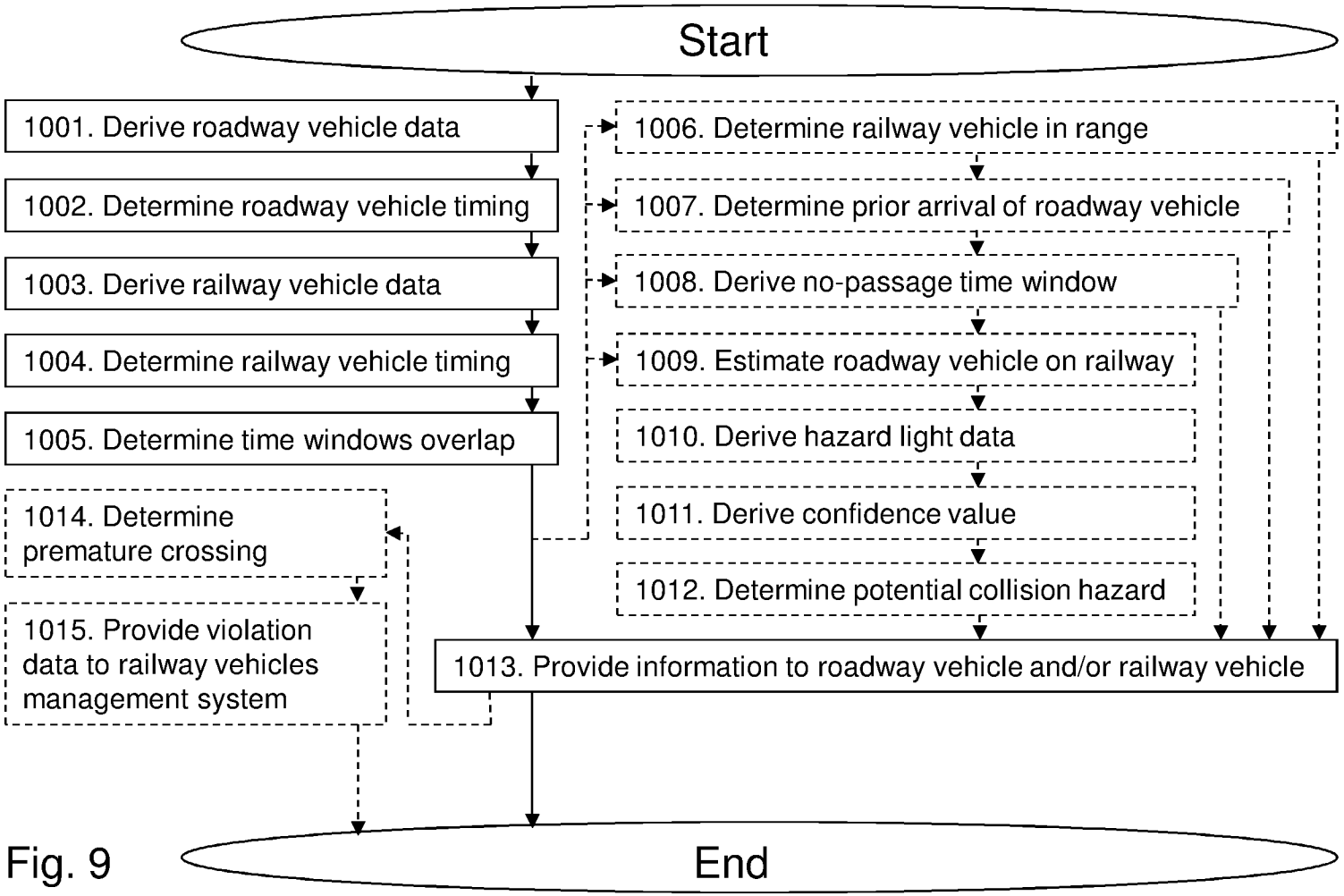
FIG. 9 is a flowchart depicting an exemplifying method for sharing of information pertinent a railway crossing of a road and a railway according to embodiments of the disclosure.

FIG. 9 is a flowchart depicting an exemplifying method for sharing of information pertinent a railway crossing 45 of a road 4 and a railway 5 according to embodiments of the disclosure. The method is performed by the information sharing system 1, for sharing of information pertinent a railway crossing 45 of a road 4 and a railway 5, which information sharing system 1 is associated with a roadway vehicles management system 2 holding vehicle status data 21 of one or more roadway vehicles. The exemplifying method, which may be continuously repeated, comprises the following actions discussed with support from FIGS. 1-8. The actions may be taken in any suitable order; for instance may Actions 1001-1002 and Actions 1003-1004 be performed simultaneously and/or in an alternate order.

Action 1001

In Action 1001, as shown with support from FIGS. 1-8, the information sharing system 1 derives from the roadway vehicles management system 2—e.g. by means of the roadway deriving unit 101—position-related data 211 of a roadway vehicle 41 along the road 41.

Action 1002

In Action 1002, as shown with support from FIGS. 1-8, the information sharing system 1 determines, based on said roadway vehicle position-related data 211, e.g. by means of the roadway determining unit 102, a roadway vehicle timing at and/or during which the roadway vehicle 41 is estimated to arrive at and/or cross the railway crossing 45.

Action 1003

In Action 1003, as shown with support from FIGS. 1-8, the information sharing system 1 derives, e.g. by means of the railway deriving unit 103, from a railway vehicles management system 6 holding vehicle status data 61 of one or more railway vehicles, position-related data 611 of a railway vehicle 51 along the railway 5.

Action 1004

In Action 1004, as shown with support from FIGS. 1-8, the information sharing system 1 determines, based on the railway vehicle position-related data 611, e.g. by means of the railway determining unit 104, a railway vehicle timing at and/or during which the railway vehicle 51 is estimated to arrive at and/or have passed the railway crossing 45.

Action 1005

In Action 1005, as shown with support from FIGS. 1-8, the information sharing system 1 determines, e.g. by means of the time window determining unit 105, based on comparing a roadway vehicle time window comprising the roadway vehicle timing, to a railway vehicle time window comprising the railway vehicle timing, that the roadway vehicle time window at least partly overlaps the railway vehicle time window.

Action 1013

In Action 1013, as shown with support from FIGS. 1-8, the information sharing system 1 provides, e.g. by means of the information providing unit 113, information 7, 8 associated with the expected overlap, to the roadway vehicle 41 and/or to the railway vehicle 51.

Action 1006

In optional Action 1006, as shown with support at least from FIGS. 1, 2 and 8, the information sharing system 1 may determine, e.g. by means of the range determining unit 106, based on comparing the roadway vehicle position-related data 211 to the railway vehicle position-related data 611, that the railway vehicle 51 is estimated to be an object 510 in range 4121 of one or more vision sensors 412 of the roadway vehicle 41. The information 7' associated with the expected overlap then comprises data based on said determining of Action 1006, which data initiates the roadway vehicle 41 to classify the object 510 as a railway vehicle.

Action 1007

In optional Action 1007, as shown with support at least from FIGS. 1, 3 and 8, the information sharing system 1 may determine, e.g. by means of the arrival determining unit 107, based on comparing the roadway vehicle position-related data 211 to the railway vehicle position-related data 611, that the roadway vehicle 41 is estimated to arrive at the railway crossing 45 prior to the railway vehicle timing. The information 7" associated with the expected overlap then comprises data based on the determining of Action 1007, which data initiates the roadway vehicle 41 to, at the railway crossing 45, monitor the railway vehicle 51 by means of one or more vision sensors 413.

Action 1008

Optionally, the railway crossing 45 may at least partly comprises an active protection system 451 with one or more level crossing barriers and/or gates adapted to be lowered, and/or one or more level crossing signs adapted to provide a warning, during a no-passage time window associated with the railway vehicle timing. Then, in optional Action 1008, as shown with support at least from FIGS. 1, 4 and 8, the information sharing system 1 derives, e.g. by means of the no-passage deriving unit 108, time information 62 of the no-passage time window from the railway vehicles management system 6. The information 7''' associated with the expected overlap then comprises data based on the time information 62, which data initiates the roadway vehicle 41 to take into account—and/or present visually and/or audibly e.g., by means of one or more optional displays 414*a* and or loudspeakers 414*b*—time to expiry of the no-passage time window.

Optionally, additionally or alternatively, the railway crossing 45 may at least partly be unprotected. Then, as shown with support at least from FIGS. 1, 6 and 8, the information 7'''' associated with the expected overlap may comprise data based on the railway vehicle time window, which data initiates the roadway vehicle 41 to take into account—and/or present an in-vehicle visual and/or audible indication e.g. by means of the one or more displays 414*a* and/or loudspeakers 414*b* until—the expiry of the railway vehicle time window.

Action 1009

In optional Action 1009, as shown with support at least from FIGS. 1, 7 and 8, the information sharing system 1 may estimate, e.g. by means of the railway position estimating unit 109, based on the roadway vehicle position-related data 211, that the roadway vehicle 41 at least partly is positioned on the railway 5 of the railway crossing 45.

Action 1010

Following upon Action 1009, in optional Action 1010, as shown with support at least from FIGS. 1, 7 and 8, the information sharing system 1 may derive, e.g. by means of the hazard light deriving unit 110, from the roadway vehicles management system 2, hazard light data 22 indicative of whether or not a hazard light alert 415 is active or not on the roadway vehicle 41.

Action 1011

Following upon Action 1010, in optional Action 1011, as shown with support at least from FIGS. 1, 7 and 8, the information sharing system 1 may then derive, e.g. by means of the confidence value deriving unit 111, a confidence value indicating a level of general confidence of position-related data in a geographical area at least partly comprising the railway crossing 45, which confidence value is based on statistical position-related data in the area. The information 7''''' associated with the expected overlap then comprises data based on the estimating of Action 1009, the deriving of Action 1010 and/or the deriving of Action 1011, which data reveals a potential collision hazard at the railway crossing 45 between the roadway vehicle 41 and the railway vehicle 51.

Action 1012

Following upon Action 1011, in optional Action 1012, as shown with support at least from FIGS. 1, 7 and 8, the information sharing system 1 may then determine, e.g. by means of the hazard determining unit 112, that the hazard light data 22 indicates that the hazard light alert 415 is active, and/or that the confidence value exceeds a predetermined minimum confidence level threshold.

Action 1014

Provided Action 1008 has been performed, in optional Action 1014, as shown with support at least from FIGS. 1, 5 and 8, the information sharing system 1 may determine, e.g. by means of the violation crossing determining unit 114, based on comparing the roadway vehicle position-related data 411 to the no-passage time window, that the roadway vehicle 41 is crossing and/or has already crossed the railway crossing 45 prior to expiry of the no-passage time window.

Action 1015

Following upon Action 1014, in optional Action 1015, as shown with support at least from FIGS. 1, 5 and 8, the information sharing system 1 may then provide, e.g. by means of the violation providing unit 115, data 9 based on the determining of Action 1014, to the railway vehicles management system 6, the railway vehicle 51, the roadway vehicles management system 2 and/or the roadway vehicle 41, the data 9 revealing a violation of the one or more level crossing barriers and/or level crossing signs.

The person skilled in the art realizes that the present disclosure by no means is limited to the embodiments described above. On the contrary, many modifications and variations are possible within the scope of the appended claims. It should furthermore be noted that the drawings not necessarily are to scale and the dimensions of certain features may have been exaggerated for the sake of clarity. Emphasis is instead placed upon illustrating the principle of the embodiments herein. Additionally, as used herein, the phrases "adapted to" or "adapted for" may refer to or include "configured to" or "configured for", the words "initiates" or "initiating" may refer to or include "causes" or "causing", the word "comprising" does not exclude other elements or steps, and the indefinite article "a" or "an" does not exclude a plurality.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A method performed by an information sharing system for sharing of information associated with a railway crossing of a road and a railway, the information sharing system associated with a roadway vehicles management system holding vehicle status data of one or more roadway vehicles, the method comprising:

deriving, from the roadway vehicles management system, position-related data of a roadway vehicle along the road;

determining, based on the roadway vehicle position-related data, a roadway vehicle timing at or during which the roadway vehicle is estimated to arrive at or cross the railway crossing;

deriving, from a railway vehicles management system holding vehicle status data of one or more railway vehicles, position-related data of a railway vehicle along the railway;

determining, based on the railway vehicle position-related data, a railway vehicle timing at or during which the railway vehicle is estimated to arrive at or have passed the railway crossing;

determining, based on comparing a roadway vehicle time window comprising the roadway vehicle timing to a railway vehicle time window comprising the railway vehicle timing, that the roadway vehicle time window and the railway vehicle time window at least partly overlap;

providing information associated with the overlap to the roadway vehicle or the railway vehicle; and determining, based on comparing the roadway vehicle position-related data to the railway vehicle position-related data, that the railway vehicle is estimated to be an object in range of one or more vision sensors of the roadway vehicle;

wherein the provided information comprises data based on the determining that the railway vehicle is estimated to be an object in range of one or more vision sensors of the roadway vehicle, the data initiating the roadway vehicle to classify the object as a railway vehicle.

2. The method according to claim 1 further comprising:

determining, based on comparing the roadway vehicle position-related data to the railway vehicle position-related data, that the roadway vehicle is estimated to arrive at the railway crossing prior to the railway vehicle timing;

wherein the provided information comprises data based on the determining that the roadway vehicle is estimated to arrive at the railway crossing prior to the railway vehicle timing, the data initiating the roadway vehicle to, at the railway crossing, monitor the railway vehicle by one or more vision sensors.

3. The method according to claim 1 wherein the railway crossing at least partly comprises an active protection system with one or more level crossing barriers or gates configured to be lowered or one or more level crossing signs configured to provide a warning during a no-passage time window associated with the railway vehicle timing, the method then further comprising:

deriving time information of the no-passage time window from the railway vehicles management system;

wherein the provided information comprises data based on the derived time information, the data initiating the roadway vehicle to present an in-vehicle visual or audible indication of time to expiry of the no-passage time window.

4. The method according to claim 3 further comprising:

determining, based on comparing the roadway vehicle position-related data to the no-passage time window, that the roadway vehicle is crossing or has already crossed the railway crossing prior to expiry of the no-passage time window; and providing data, based on the determining that the roadway vehicle is crossing or has already crossed the railway crossing prior to expiry of the no-passage time window, to the railway vehicles management system, the railway vehicle, the roadway vehicles management system or the roadway vehicle, the data revealing a violation of the one or more level crossing barriers or level crossing signs.

5. The method according to claim 1 wherein the railway crossing at least partly is unprotected, the provided information comprising data based on the railway vehicle time window, the data initiating the roadway vehicle to present an in-vehicle visual or audible indication until the expiry of the railway vehicle time window.

6. The method according to claim 1 further comprising:

estimating, based on the roadway vehicle position-related data, that the roadway vehicle at least partly is positioned on the railway of the railway crossing;

deriving, from the roadway vehicles management system, hazard light data indicative of whether a hazard light alert is active on the roadway vehicle, and/or deriving a confidence value indicating a level of confidence of position-related data in a geographical area at least partly comprising the railway crossing, which confidence value is based on statistical position-related data in the area; and determining that the hazard light data indicates that the hazard light alert is active, and/or that the confidence value exceeds a predetermined minimum confidence level threshold, wherein the provided information comprises data based on the estimating that the roadway vehicle at least partly is positioned on the railway of the railway crossing and the deriving hazard light data and/or a confidence value, the data revealing a potential collision hazard at the railway crossing between the roadway vehicle and the railway vehicle.

7. An information sharing system for sharing of information associated with a railway crossing of a road and a railway, the information sharing system configured to associate with a roadway vehicles management system holding vehicle status data of one or more roadway vehicles, the information sharing system comprising:

a roadway deriving unit configured for deriving, from the roadway vehicles management system, position-related data of a roadway vehicle along the road;

a roadway determining unit configured for determining, based on the roadway vehicle position-related data, a roadway vehicle timing at or during which the roadway vehicle is estimated to arrive at or cross the railway crossing;

a railway deriving unit configured for deriving from, a railway vehicles management system holding vehicle status data of one or more railway vehicles, position-related data of a railway vehicle along the railway;

a railway determining unit configured for determining, based on the railway vehicle position-related data, a railway vehicle timing at or during which the railway vehicle is estimated to arrive at or have passed the railway crossing;

a time window determining unit configured for determining, based on comparing a roadway vehicle time window comprising the roadway vehicle timing to a railway vehicle time window comprising the railway vehicle timing, that the roadway vehicle time window and the railway vehicle time window at least partly overlap;

an information providing unit configured for providing information associated with overlap to the roadway vehicle or the railway vehicle; and a range determining unit configured for determining, based on comparing the roadway vehicle position-related data to the railway vehicle position-related data, that the railway vehicle is estimated to be an object in range of one or more vision sensors of the roadway vehicle;

wherein the provided information comprises data based on the determining that the railway vehicle is estimated to be an object in range of one or more vision sensors of the roadway vehicle, the data initiating the roadway vehicle to classify the object as a railway vehicle.

8. The information sharing system according to claim 7 further comprising:

an arrival determining unit configured for determining, based on comparing the roadway vehicle position-related data to the railway vehicle position-related data, that the roadway vehicle is estimated to arrive at the railway crossing prior to the railway vehicle timing;

wherein the provided information comprises data based on the determining that the roadway vehicle is estimated to arrive at the railway crossing prior to the railway vehicle timing, the data initiating the roadway vehicle to, at the railway crossing, monitor the railway vehicle by one or more vision sensors.

9. The information sharing system according to claim 7 wherein the railway crossing at least partly comprises an active protection system with one or more level crossing barriers or gates configured to be lowered or one or more level crossing signs configured to provide a warning during a no-passage time window associated with the railway vehicle timing, the information sharing system further comprising:

a no-passage deriving unit configured for deriving time information of the no-passage time window from the railway vehicles management system;

wherein the provided information comprises data based on the derived time information, the data initiating the roadway vehicle to present an in-vehicle visual or audible indication of time to expiry of the no-passage time window.

10. The information sharing system according to claim 9 further comprising:

a violation crossing determining unit configured for determining, based on comparing the roadway vehicle position-related data to the no-passage time window, that the roadway vehicle is crossing or has already crossed the railway crossing prior to expiry of the no-passage time window; and a violation providing unit configured for providing data, based on the determining that the roadway vehicle is crossing or has already crossed the railway crossing prior to expiry of the no-passage time window, to the railway vehicles management system, the railway vehicle, the roadway vehicles management system or the roadway vehicle, the data revealing a violation of the one or more level crossing barriers or level crossing signs.

11. The information sharing system according to claim 7 wherein the railway crossing at least partly is unprotected, the provided information comprising data based on the railway vehicle time window, the data initiating the roadway vehicle to present an in-vehicle visual or audible indication until the expiry of the railway vehicle time window.

12. The information sharing system according to claim 7 further comprising:

a railway position estimating unit configured for estimating, based on the roadway vehicle position-related data, that the roadway vehicle at least partly is positioned on the railway of the railway crossing;

a hazard light deriving unit and/or a confidence value deriving unit, the hazard light deriving unit configured for deriving, from the roadway vehicles management system, hazard light data indicative of whether a hazard light alert is active on the roadway vehicle, the confidence value deriving unit configured for deriving a confidence value indicating a level of confidence of position-related data in a geographical area at least partly comprising the railway crossing, which confidence value is based on statistical position-related data in the area; and a hazard determining unit configured for determining that the hazard light data indicates that the hazard light alert is active, and/or that the confidence value exceeds a predetermined minimum confidence level threshold;

wherein the provided information comprises data based on the estimating that the roadway vehicle at least partly is positioned on the railway of the railway crossing and the deriving hazard light data and/or a confidence value, the data revealing a potential collision hazard at the railway crossing between the roadway vehicle and the railway vehicle.

13. A non-transitory computer readable medium having stored computer executable instructions which, when executed in an information sharing system for sharing of information associated with a railway crossing of a road and a railway, the information sharing system associated with a roadway vehicles management system holding vehicle status data of one or more roadway vehicles, cause the information sharing system to:

derive, from the roadway vehicles management system, position-related data of a roadway vehicle along the road;

determine, based on the roadway vehicle position-related data, a roadway vehicle timing at or during which the roadway vehicle is estimated to arrive at or cross the railway crossing;

derive, from a railway vehicles management system holding vehicle status data of one or more railway vehicles, position-related data of a railway vehicle along the railway;

determine, based on the railway vehicle position-related data, a railway vehicle timing at or during which the railway vehicle is estimated to arrive at or have passed the railway crossing;

determine, based on comparing a roadway vehicle time window comprising the roadway vehicle timing to a railway vehicle time window comprising the railway vehicle timing, that the roadway vehicle time window and the railway vehicle time window at least partly overlap;

provide information associated with the overlap to the roadway vehicle or the railway vehicle; and determine, based on comparing the roadway vehicle position-related data to the railway vehicle position-related data, that the railway vehicle is estimated to be an object in range of one or more vision sensors of the roadway vehicle;

wherein the provided information comprises data based on the determining that the railway vehicle is estimated to be an object in range of one or more vision sensors of the roadway vehicle, the data initiating the roadway vehicle to classify the object as a railway vehicle.

14. A method performed by an information sharing system for sharing of information associated with a railway crossing of a road and a railway, the information sharing system associated with a roadway vehicles management system holding vehicle status data of one or more roadway vehicles, the method comprising:

deriving, from the roadway vehicles management system, position-related data of a roadway vehicle along the road;

determining, based on the roadway vehicle position-related data, a roadway vehicle timing at or during which the roadway vehicle is estimated to arrive at or cross the railway crossing;

deriving, from a railway vehicles management system holding vehicle status data of one or more railway vehicles, position-related data of a railway vehicle along the railway;

determining, based on the railway vehicle position-related data, a railway vehicle timing at or during which the railway vehicle is estimated to arrive at or have passed the railway crossing;

determining, based on comparing a roadway vehicle time window comprising the roadway vehicle timing to a railway vehicle time window comprising the railway vehicle timing, that the roadway vehicle time window and the railway vehicle time window at least partly overlap;

providing information associated with the overlap to the roadway vehicle or the railway vehicle; and determining, based on comparing the roadway vehicle position-related data to the railway vehicle position-related data, that the roadway vehicle is estimated to arrive at the railway crossing prior to the railway vehicle timing;

wherein the provided information comprises data based on the determining that the roadway vehicle is estimated to arrive at the railway crossing prior to the railway vehicle timing, the data initiating the roadway vehicle to, at the railway crossing, monitor the railway vehicle by one or more vision sensors.

15. The method according to claim 14 wherein the railway crossing at least partly comprises an active protection system with one or more level crossing barriers or gates configured to be lowered or one or more level crossing signs configured to provide a warning during a no-passage time window associated with the railway vehicle timing, the method then further comprising:

deriving time information of the no-passage time window from the railway vehicles management system;

wherein the provided information comprises data based on the derived time information, the data initiating the roadway vehicle to present an in-vehicle visual or audible indication of time to expiry of the no-passage time window.

16. The method according to claim 15 further comprising:

determining, based on comparing the roadway vehicle position-related data to the no-passage time window, that the roadway vehicle is crossing or has already crossed the railway crossing prior to expiry of the no-passage time window; and providing data, based on the determining that the roadway vehicle is crossing or has already crossed the railway crossing prior to expiry of the no-passage time window, to the railway vehicles management system, the railway vehicle, the roadway vehicles management system or the roadway vehicle, the data revealing a violation of the one or more level crossing barriers or level crossing signs.

17. An information sharing system for sharing of information associated with a railway crossing of a road and a railway, the information sharing system configured to associate with a roadway vehicles management system holding vehicle status data of one or more roadway vehicles, the information sharing system comprising:

a roadway deriving unit configured for deriving, from the roadway vehicles management system, position-related data of a roadway vehicle along the road;

a roadway determining unit configured for determining, based on the roadway vehicle position-related data, a roadway vehicle timing at or during which the roadway vehicle is estimated to arrive at or cross the railway crossing;

a railway deriving unit configured for deriving from, a railway vehicles management system holding vehicle status data of one or more railway vehicles, position-related data of a railway vehicle along the railway;

a railway determining unit configured for determining, based on the railway vehicle position-related data, a railway vehicle timing at or during which the railway vehicle is estimated to arrive at or have passed the railway crossing;

a time window determining unit configured for determining, based on comparing a roadway vehicle time window comprising the roadway vehicle timing to a railway vehicle time window comprising the railway vehicle timing, that the roadway vehicle time window and the railway vehicle time window at least partly overlap;

an information providing unit configured for providing information associated with overlap to the roadway vehicle or the railway vehicle; and an arrival determining unit configured for determining, based on comparing the roadway vehicle position-related data to the railway vehicle position-related data, that the roadway vehicle is estimated to arrive at the railway crossing prior to the railway vehicle timing;

wherein the provided information comprises data based on the determining that the roadway vehicle is estimated to arrive at the railway crossing prior to the railway vehicle timing, the data initiating the roadway vehicle to, at the railway crossing, monitor the railway vehicle by one or more vision sensors.

18. The information sharing system according to claim 17 wherein the railway crossing at least partly comprises an active protection system with one or more level crossing barriers or gates configured to be lowered or one or more level crossing signs configured to provide a warning during a no-passage time window associated with the railway vehicle timing, the information sharing system further comprising:

a no-passage deriving unit configured for deriving time information of the no-passage time window from the railway vehicles management system;

wherein the provided information comprises data based on the derived time information, the data initiating the roadway vehicle to present an in-vehicle visual or audible indication of time to expiry of the no-passage time window.

19. The information sharing system according to claim 18 further comprising:

a violation crossing determining unit configured for determining, based on comparing the roadway vehicle position-related data to the no-passage time window, that the roadway vehicle is crossing or has already crossed the railway crossing prior to expiry of the no-passage time window; and a violation providing unit configured for providing data, based on the determining that the roadway vehicle is crossing or has already crossed the railway crossing prior to expiry of the no-passage time window, to the railway vehicles management system, the railway vehicle, the roadway vehicles management system or the roadway vehicle, the data revealing a violation of the one or more level crossing barriers or level crossing signs.

20. A non-transitory computer readable medium having stored computer executable instructions which, when executed in an information sharing system for sharing of information associated with a railway crossing of a road and a railway, the information sharing system associated with a roadway vehicles management system holding vehicle status data of one or more roadway vehicles, cause the information sharing system to:

derive, from the roadway vehicles management system, position-related data of a roadway vehicle along the road;

determine, based on the roadway vehicle position-related data, a roadway vehicle timing at or during which the roadway vehicle is estimated to arrive at or cross the railway crossing;

derive, from a railway vehicles management system holding vehicle status data of one or more railway vehicles, position-related data of a railway vehicle along the railway;

determine, based on the railway vehicle position-related data, a railway vehicle timing at or during which the railway vehicle is estimated to arrive at or have passed the railway crossing;

determine, based on comparing a roadway vehicle time window comprising the roadway vehicle timing to a railway vehicle time window comprising the railway vehicle timing, that the roadway vehicle time window and the railway vehicle time window at least partly overlap;

provide information associated with the overlap to the roadway vehicle or the railway vehicle; and determine, based on comparing the roadway vehicle position-related data to the railway vehicle position-related data, that the roadway vehicle is estimated to arrive at the railway crossing prior to the railway vehicle timing;

wherein the provided information comprises data based on the determining that the roadway vehicle is estimated to arrive at the railway crossing prior to the railway vehicle timing, the data initiating the roadway vehicle to, at the railway crossing, monitor the railway vehicle by one or more vision sensors.

* * * * *